US012448878B1

(12) United States Patent
Brown et al.

(10) Patent No.: US 12,448,878 B1
(45) Date of Patent: Oct. 21, 2025

(54) GAS SEPARATOR FOR ELECTRIC SUBMERSIBLE PUMP

(71) Applicant: Halliburton Energy Services, Inc., Houston, TX (US)

(72) Inventors: Donn J. Brown, Tulsa, OK (US); Ketankumar Kantilal Sheth, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/003,154

(22) Filed: Dec. 27, 2024

(51) Int. Cl.
*E21B 43/38* (2006.01)
*E21B 43/12* (2006.01)

(52) U.S. Cl.
CPC ..... *E21B 43/38* (2013.01); *E21B 43/128* (2013.01)

(58) Field of Classification Search
CPC ..... E21B 43/38; E21B 43/128
See application file for complete search history.

(56) References Cited

U.S. PATENT DOCUMENTS 9,574,562 B2 * 2/2017 Van Dam ..... F04D 29/688
10,683,876 B2 * 6/2020 Brown ..... F04D 13/10
11,624,269 B2 * 4/2023 Sheth ..... E21B 43/38 166/372
11,867,035 B2 1/2024 Brown et al.
12,000,258 B2 6/2024 Brown et al.
12,152,474 B2 11/2024 Brown et al.
12,292,059 B2 * 5/2025 Dyck ..... E21B 43/128

OTHER PUBLICATIONS

Filing Receipt, Specification and Drawings for U.S. Appl. No. 19/003,194, entitled "Gas Separator for Electric Submersible Pump," filed Dec. 27, 2024, 66 pages.

* cited by examiner

*Primary Examiner* — Aaron L Lembo

(74) *Attorney, Agent, or Firm* — Conley Rose, P.C.; Rodney B. Carroll

(57) ABSTRACT

A gas separator for an electric submersible pump includes an inlet, an outlet, and a first portion including a first inner circumferential surface and a first outer circumferential surface having a first diameter. The first portion is disposed between the inlet and the outlet. The gas separator further includes a second portion including a second inner circumferential surface and a second outer circumferential surface having a second diameter. The second portion is disposed between the first portion and the outlet. The first diameter is less than the second diameter.

20 Claims, 12 Drawing Sheets

GAS SEPARATOR FOR ELECTRIC SUBMERSIBLE PUMP

BACKGROUND

Electric submersible pumps (hereafter "ESP" or "ESPs") may be used to lift production fluid in a wellbore. Specifically, ESPs may be used to pump the production fluid to the surface in wells with low reservoir pressure. ESPs may be of importance in wells having low bottomhole pressure or for use with production fluids having a low gas/oil ratio, a low bubble point, a high water cut, and/or a low API gravity. Moreover, ESPs may also be used in any production operation to increase the flow rate of the production fluid to a target flow rate.

The reservoir fluids that enter the ESP may sometimes comprise a gas fraction. These gases may flow upwards through the liquid portion of the reservoir fluid in the pump. The gases may even separate from the other fluids when the pump is in operation. If a large volume of gas enters the ESP, or if a sufficient volume of gas accumulates on the suction side of the ESP, the gas may interfere with ESP operation and potentially prevent the intake of the reservoir fluid. This phenomenon is sometimes referred to as a "gas lock" because the ESP may not be able to operate properly due to the accumulation of gas within the ESP.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
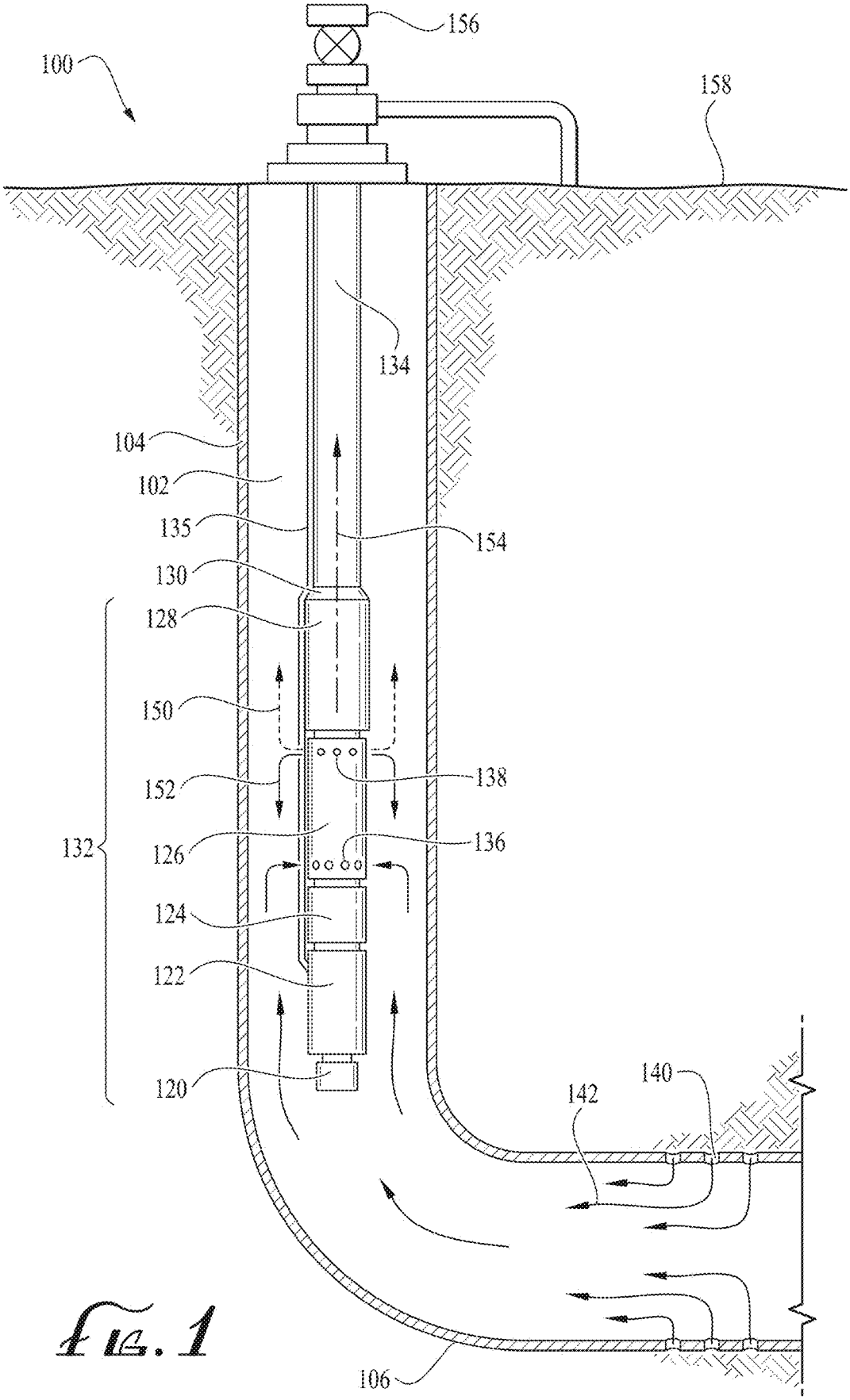
FIG. 1 is a schematic diagram of an ESP assembly, according to an embodiment of the present disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein, the term "gas separator" broadly refers to any structure or part of a structure capable of separating gas from liquid. In some embodiments, the term "gas separator" refers to a fluid intake or a structure comprising a fluid intake. In some embodiments, the gas separator comprises a gas separation chamber. In some embodiments, the gas separator comprises a base, a fluid mover, and/or an auger.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid, for example relative to flow of well fluid in the well. As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid.

According to an aspect, and without wishing to be bound by any theory, velocity of fluid inside a gas separator can cause a drag force on the gas entrained in the liquid. This can prevent the gas from exiting the gas separator. According to an embodiment of the present disclosure, an annular volume for recirculating fluids outside of the separator is greater relative to other portions of the separator, thereby reducing (e.g., slowing) the velocity of the fluid in that volume. This reduction in velocity can decrease the drag force on the gas entrained in the liquid in its gravity-induced path back to the separator's intake ports. The reduction in drag force can reduce the recirculation of gas by propensity of natural buoyancy. The liquid may be vented from the separator exit ports and return back to the separator intake port while the gas may be vented from the separator exit ports and rise up the annulus. By having enlarged the volume between the outside wall of the gas separator's housing and the inside wall of the well casing between the separator's intake and exit ports, the gas separator according to the present disclosure can inhibit the recirculation of gas (e.g., by having a relatively small housing diameter in that particular area). For example, a first portion of a housing of the gas separator may be 4 inches in diameter and another portion of the housing below the first portion of the housing may be 3.38-inches diameter in diameter.

The separation of the gas phase from the liquid phase may depend on the viscosity and velocity of the fluid. Under typical conditions, if the flow rate is greater than 10 ft/second, gas may remain entrained due to drag force. If flow rate is less than 10 ft/second approximately, gas may rise (e.g., the buoyancy force on the gas phase exceeds the drag force on the gas phase). An elongated annular space may be advantageous in that there is more opportunity for gas to bubble up. The structural configuration of the gas separator according to the present embodiment may achieve a flow rate of less than 10 ft/second approximately, and thus effectively allow the gas to rise.

According to another aspect, and without wishing to be bound by any theory, fluid movers may cause fluid to flow through the intake ports. The fluid movers could be above or below the intake ports. Fluid may rush in, causing turbulence around the separator and seal. When there is a slug of liquid that goes through the gas separator, it may expel 50-60 percent of liquid back to annulus, some of the expelled fluid returning back to the intake. There could also be a slug of gas coming past the seal to the intake. Both liquid and gas may compete to enter the inlet port because of the low pressure. Liquid falls due to gravity, exerting a drag force on the gas, which has its own buoyancy force. The mixture of two phases may enter the intake and go through the separator, and the separator may process it. The horsepower requirement of the gas separator's internal fluid movers may present a problem if there is limited electrical power available. It may also require substantial electrical operational cost to produce a given well. To mitigate the horsepower requirement, a volume for liquid retention may be provided below the fluid mover with elements for creating turbulence. For example, there may be a liquid storage area containing alternating-flow-direction spider bearings which also serve as shaft support. Hydrostatic head of the liquid in the well and the low-pressure area caused by the gas separator's fluid movers may draw fluid from the well bore. The alternating directional spider bearing vanes (e.g., respectively having clockwise and counterclockwise vanes in an alternating pattern) may induce rotation in the fluid in an alternating manner as the fluid travels through the extended intake. This alternating-directional flow may serve to mix the gas and liquid, homogenized mixture of small to fine bubbles and liquid, before it reaches the fluid movers, which may aid in the gas separator's ability to process the liquid for delivery to the downstream pump. This feature in the gas separator may enhance its ability to process the fluid, thus mitigating the horsepower requirement necessary for operation. In particular, turbulent flow created by the elements may break large bubbles down to smaller bubbles, which may lead to improved processing by the pump stages. With smaller bubbles, there may be lesser drag force. Small bubbles may be easily picked up and carried away by liquid, thus enhancing the ability of the pumps to process the fluid.

Referring to FIG. 1, a well site environment 100, according to one or more aspects of the present disclosure, is shown. The well site environment 100 comprises a wellbore 102 that is at least partially cased with casing 104. As depicted in FIG. 1, the wellbore 102 has a deviated or horizontal portion 106, but the ESP assembly 132 described herein may be used in a wellbore 102 that does not have a deviated or horizontal portion 106. The well site environment 100 may be at an on-shore location or at an off-shore location. The ESP assembly 132 in an embodiment comprises a sensor package 120, an electric motor 122, a seal unit 124, a gas separator assembly 126, and a centrifugal pump assembly 128. The centrifugal pump assembly 128 may be coupled to a production tubing 134 via a connector 130. An electric cable 135 may attach to the electric motor 122 and extend to the surface 158 to connect to an electric power source. The gas separator assembly 126 comprises one or more inlet ports 136 and gas phase discharge ports 138. The casing 104 and/or wellbore 102 may have perforations 140 that allow reservoir fluid 142 to pass from the subterranean formation through the perforations 140 and into the wellbore 102. In another embodiment, the one or more inlet ports 136 (e.g., a fluid inlet) are separate components that couple at a downhole end to the seal unit 124 and couple at an uphole end to the gas separator assembly 126. The one or more inlet ports 136 may be disposed between the seal unit 124 and the gas separator assembly 126. An interior of the uphole end of the inlet ports 136 may be fluidically coupled to an interior of the gas separator.

The reservoir fluid 142 may flow uphole towards the ESP assembly 132 and into the inlet ports 136. The reservoir fluid 142 may comprise a liquid phase fluid. The reservoir fluid 142 may comprise a gas phase fluid mixed with a liquid phase fluid. The reservoir fluid 142 may comprise only a gas phase fluid (e.g., simply gas). Over time, the gas to fluid ratio of the reservoir fluid 142 may change dramatically. For example, in the horizontal portion 106 of the wellbore gas may build up in high points in the roof of the wellbore 102 and after accumulating sufficiently may "burp" out of these high points and flow downstream to the ESP assembly 132 as what is commonly referred to as a gas slug. Thus, immediately before a gas slug arrives at the ESP assembly 132, the gas fluid ratio of the reservoir fluid 142 may be very low (e.g., the reservoir fluid 142 at the ESP assembly 132 is mostly liquid phase fluid); when the gas slug arrives at the ESP assembly 132, the gas fluid ratio is very high (e.g., the reservoir fluid 142 at the ESP assembly 132 is entirely or almost entirely gas phase fluid); and after the gas slug has passed the ESP assembly 132, the gas fluid ratio may again be very low (e.g., the reservoir fluid 142 at the ESP assembly 132 is mostly liquid phase fluid).

Under normal operating conditions (e.g., reservoir fluid 142 is flowing out of the perforations 140, the ESP assembly 132 is energized by electric power, the electric motor 122 is turning, and a gas slug is not present at the ESP assembly 132), the reservoir fluid 142 enters the inlets 136, the reservoir fluid 142 is separated by the gas separator assembly 126 into a gas phase fluid (or a mixed-phase fluid having a higher gas liquid ratio than the reservoir fluid 142 entering the inlet ports 136) and a liquid phase fluid (or a mixed-phase fluid having a lower gas liquid ratio than the reservoir fluid 142 entering the inlet ports 136). The gas phase fluid is discharged via the gas phase discharge ports 138, and the liquid phase fluid flows downstream to the centrifugal pump assembly 128 as liquid phase fluid 154. Under normal operating conditions, the gas phase fluid that is discharged into the annulus between the casing 104 and the outside of the ESP assembly 132 may comprise both gas phase fluid 150 that rises uphole in the wellbore 102 and liquid phase fluid 152 that falls downhole in the wellbore 102. The centrifugal pump assembly 128 flows the liquid phase fluid 154 (e.g., a portion of the reservoir fluid 142) up the production tubing 134 to a wellhead 156 at the surface 158.

Figure 2:
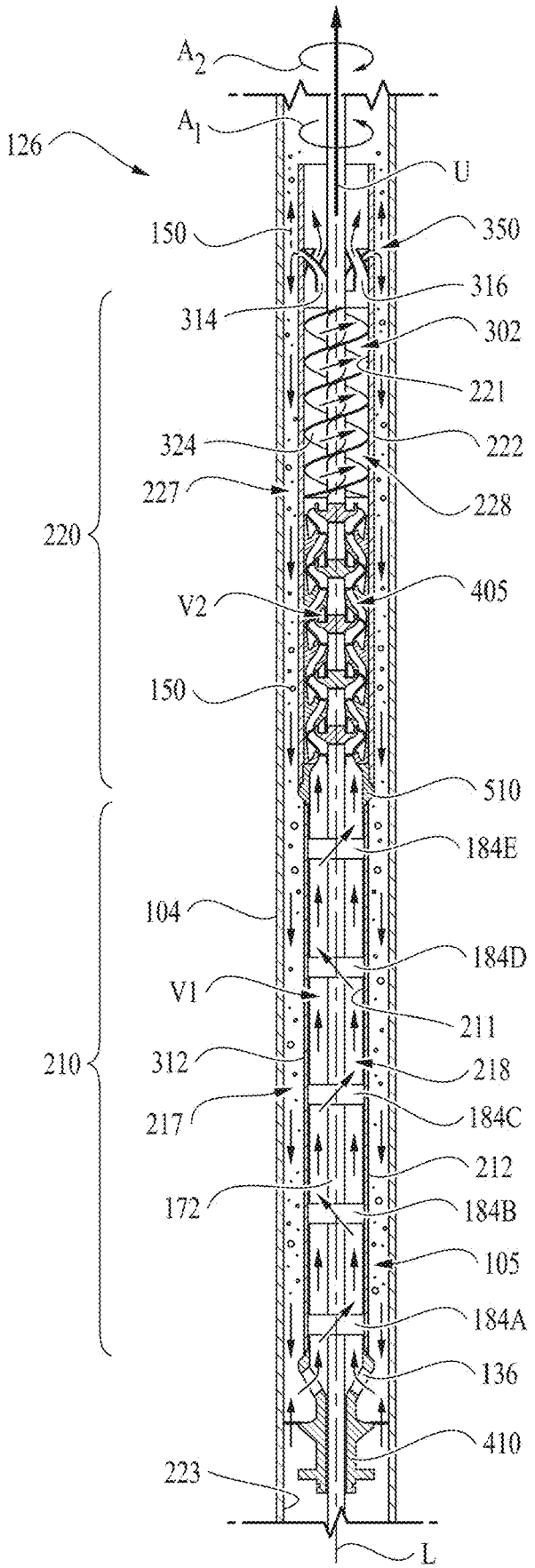
FIG. 2 is a cross-sectional view of a gas separator, according to an embodiment.

Referring to FIGS. 1-3, further details of the gas separator assembly 126 are described. The gas separator assembly 126 may include a base 410, which may have inlet ports 136 and may be disposed at an upstream end of the housing 312. The base 410 may be mechanically coupled to the housing 312 (e.g., by threads). The base 410 may be coupled to the seal unit 124, for example with a bolted connection or a threaded coupling. The housing 312 may be a cylindrical hollow metal pipe. An inside of the housing 312 may be machined or drilled at one or more locations to create slots or shallow holes for fixing and retaining components within the housing 312, for example, diffusers, bearings, or other components.

The housing 312 may enclose centrifugal pump stages 405. Each centrifugal pump stage 405 may include an impeller 406 mechanically coupled to a drive shaft 172 of the gas separator assembly 126 and a diffuser 408 that is retained and held stationary by the housing 312. The impeller 406 may have a keyway that mates with a keyway in the drive shaft 172, and the keyway of the impeller 406 may be secured to the keyway in the drive shaft 172 by a key. In some embodiments, the impeller 406 may be mechanically coupled to the drive shaft 172 in a different way. When the drive shaft 172 turns, the impeller 406 turns. The first centrifugal pump stage 405A may include a first impeller 406A and a first diffuser 408A; the second centrifugal pump stage 405B may include a second impeller 406B and a second diffuser 408B; the third centrifugal pump stage 405C may include a third impeller 406C and a third diffuser 408C; and a fourth centrifugal pump stage 405D may include a fourth impeller 406D and a fourth diffuser 408D. Any number of pump stages is within the scope of the present disclosure. For example, there may be a single centrifugal pump stage 405, three centrifugal pump stages 405, four centrifugal pump stages 405, five centrifugal pump stages 405, six centrifugal pump stages 405, or more centrifugal pump stages 405 located between the base 410 and the fluid reservoir. Above the fourth diffuser 408D (or whichever is the upper-most diffuser) may be an end impeller (e.g., a fifth impeller 406E) without a corresponding diffuser. This configuration may be advantageous because it may reduce erosion. Angular velocity of fluid may match the angular velocity of the fifth impeller and/or the angle at which the fluid exits the end impeller may reduce eddy currents. In some embodiments, the centrifugal pump stages are replaced by a rotational auger (e.g., a vortex separator) or a paddle wheel.

The centrifugal pump stages 405 may be referred to as a fluid mover in some contexts. In some embodiments, the centrifugal pump stages 405 of the gas separator assembly 126 are replaced by another fluid mover mechanism, for example, an auger mechanically coupled to the drive shaft 172, one or more impellers mechanically coupled to the drive shaft 172 (e.g., without a corresponding diffuser), and/or a paddle wheel mechanically coupled to the drive shaft 172. The auger may comprise one or more vanes and a shaft that encloses the drive shaft 172.

Referring to FIGS. 1-2. the drive shaft 172 may be mechanically coupled to a drive shaft of the seal unit(s) 124, and the drive shaft of the seal unit 124 may be mechanically coupled to a drive shaft of the electric motor(s) 122. Thus, the drive shaft 172 and the impellers 406 of the one or more centrifugal pump stages 405 may be turned indirectly by the electric motor 122 when it is energized by electric power via the electric cable 135. The drive shaft 172 may be mechanically coupled to a drive shaft of the centrifugal pump assembly 128 and may transfer rotational power to the drive shaft of the centrifugal pump assembly 128 and to impellers of the centrifugal pump stages of the centrifugal pump assembly 128. The several different drive shaft mechanical couplings may be provided by splines cut in the mating ends of shafts and coupled by a spline coupler or hub. In another embodiment, the drive shaft mechanical couplings may be provided by other devices.

Referring to FIGS. 2-4 and 3A-3D, the housing 312 may also enclose a stationary auger 302. The stationary auger 302 may be disposed within a sleeve. The centrifugal pump stages 405 may force reservoir fluid 142 received at the one or more inlet ports 136 through the fluid reservoir and through the stationary auger 302. An outside edge of the stationary auger 302 may sealingly engage with an inside surface of the sleeve, thus confining the flow of reservoir fluid 142 through the sleeve to the passageway or passageways defined by the stationary auger 302. The sleeve may be disposed within and retained by the housing 312. In some embodiments, the stationary auger 302 and the sleeve may be built or manufactured as a single component.

In some embodiments, there is no sleeve and the stationary auger 302 is disposed within the inside of the housing 312. The stationary auger 302 may be retained by the inside of the housing 312. In an embodiment, the stationary auger 302 engages sealingly with an inside surface of the housing 312. In an embodiment, there is a space between the outside edges of the stationary auger 302 and the inside surface of the sleeve or a space between the outside edges of the stationary auger 302 and the inside surface of the housing 312.

In one or more embodiments, the stationary auger 302 comprises one or more helixes or vanes 324. In one or more embodiments, the helixes or vanes 324 may be crescent-shaped. In one or more embodiments, the stationary auger 302 comprises one or more helixes or vanes 324 disposed about a solid core, for example a shaft that encloses the drive shaft 172, or an open core (for example, a coreless auger or an auger flighting). The stationary auger 302 may cause the reservoir fluid 142 to be separated into a liquid phase fluid and gas phase fluid based, at least in part, on rotational flow of the reservoir fluid.

For example, the one or more helixes or vanes 324 may impart rotation to the reservoir fluid 142 as the reservoir fluid 142 flows through, across or about the one or more helixes or vanes 324. The stationary auger 302, then, can be referred to as a fluid mover at least because it imparts a rotating motion to the reservoir fluid 142 as the reservoir fluid 142 flows through the stationary auger 302. For example, the fluid mover forces the reservoir fluid 142 at a velocity or flow rate into the sleeve and up or across the one or more helixes or vanes 324 of stationary auger 302. The rotation of the reservoir fluid 142 induced by the stationary auger 302 may be based, at least in part, on the velocity or flow rate of the reservoir fluid 142 generated by the centrifugal pump stages 405. For example, the centrifugal pump stages 405 may increase the flow rate or velocity of the reservoir fluid 142 to increase rotation of the reservoir fluid 142 through the stationary auger 302 to create a more efficient and effective separation of the reservoir fluid 142 into a plurality of phases, for example, a liquid phase fluid and a gas phase fluid. As the reservoir fluid 142 flows through the stationary auger 302, centrifugal forces, static friction or both, cause the heavier component of the reservoir fluid 142, a liquid phase fluid, to circulate along an outer perimeter of the stationary auger 302 while the lighter component of the reservoir fluid 142, the gas phase fluid, is circulated along an inner perimeter of the stationary auger 302. In one or more embodiments, reservoir fluid 142 may begin to separate while flowing through stationary auger 302. In one or more embodiments, the liquid phase fluid may comprise residual gas that did not separate into the gas phase fluid. However, the embodiments discussed herein reduce this residual gas to protect the centrifugal pump assembly from gas build-up or gas lock.

In an embodiment, the stationary auger 302 is not present and instead a different kind of fluid mover is provided. The fluid mover may be provided by an auger mechanically coupled to the drive shaft 172, a paddle wheel mechanically coupled to the drive shaft 172, a centrifuge rotor mechanically coupled to the drive shaft 172, or an impeller mechanically coupled to the drive shaft 172 that induces rotational motion of the reservoir fluid 142. In an embodiment, a third fluid mover is provided downstream of the stationary auger 302. For example, a paddle wheel may be installed downstream of the stationary auger 302 that induces and/or increases rotating motion of the reservoir fluid 142.

Figure 3A:
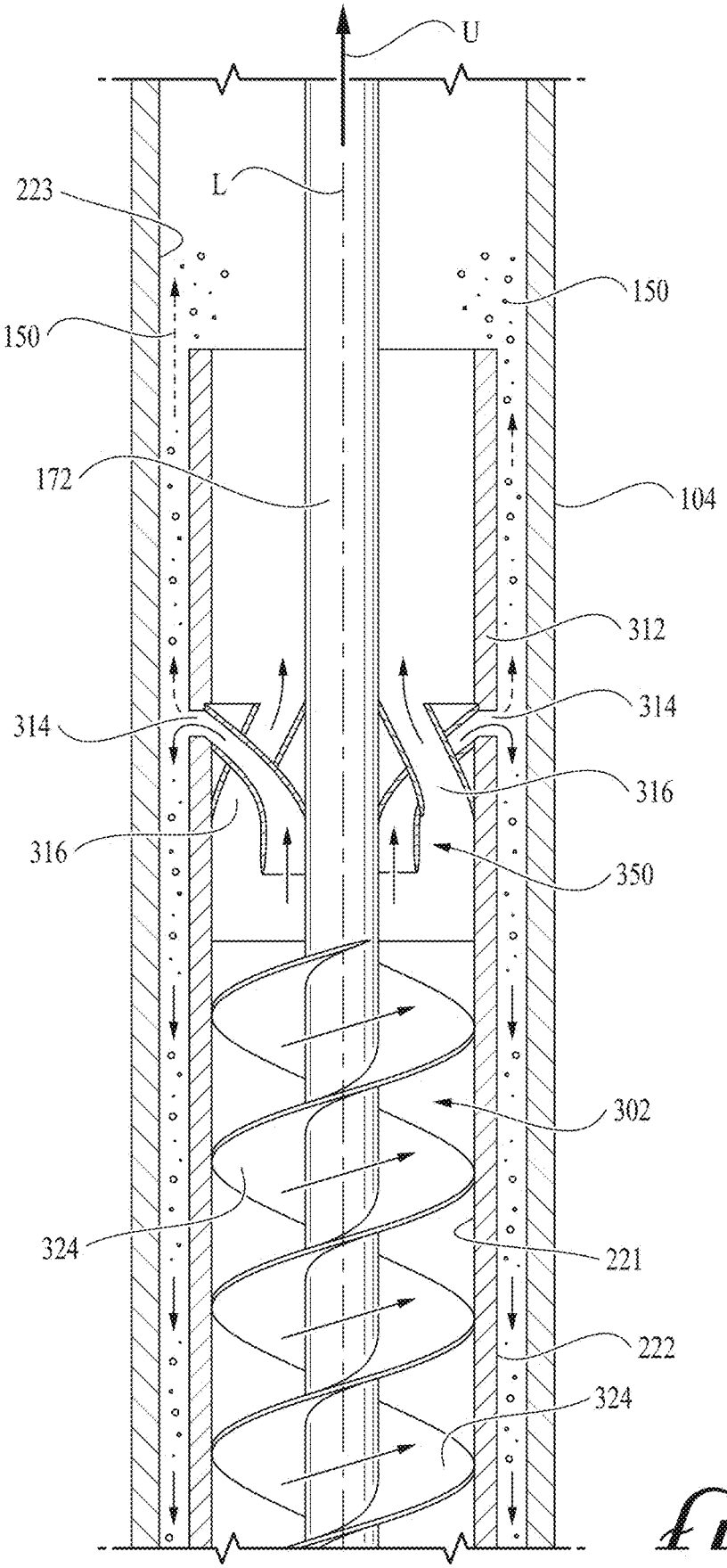
FIG. 3A is an enlarged cross-sectional view of an upper portion of the gas separator of FIG. 2.
Figure 3B:
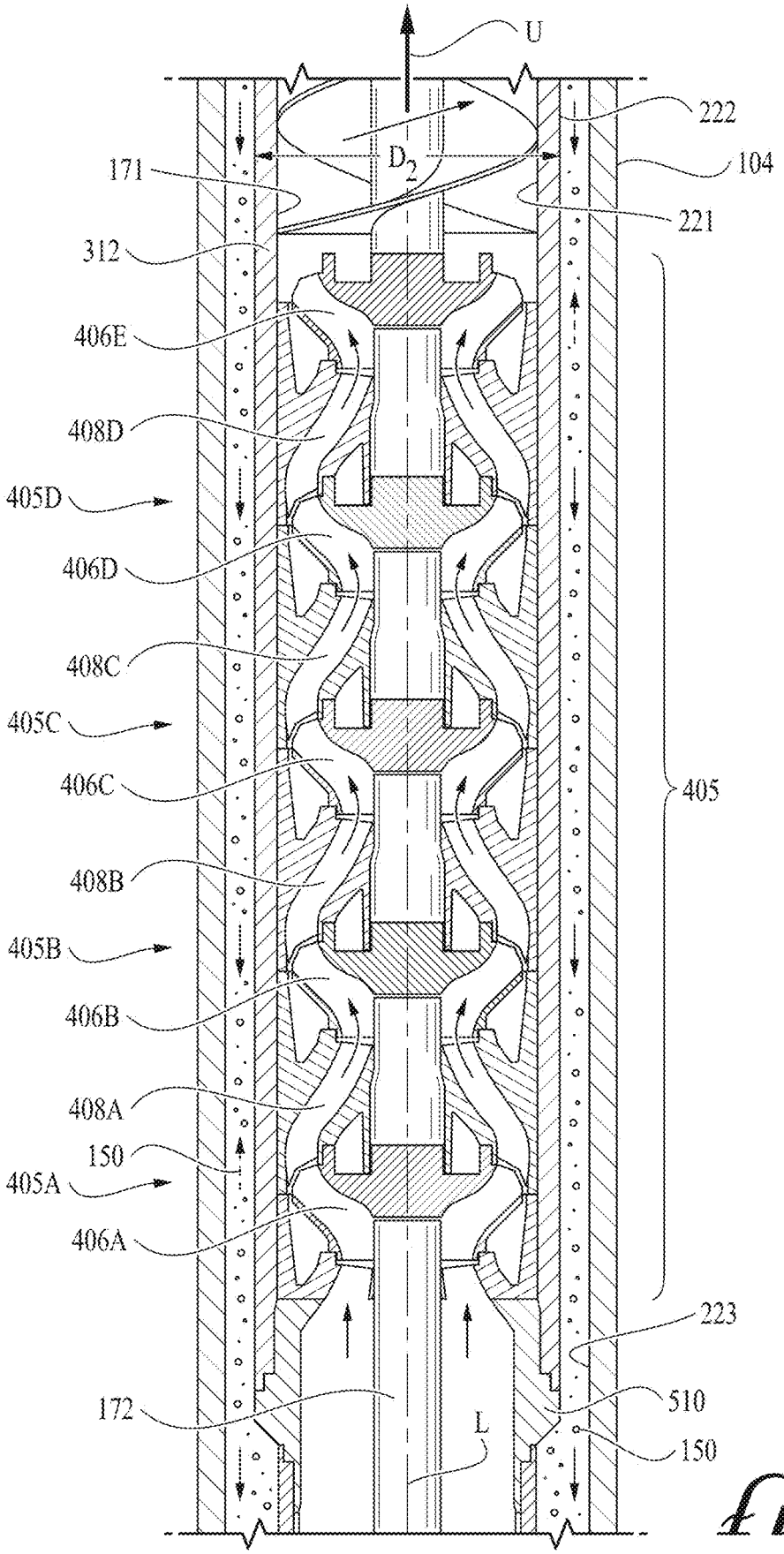
FIG. 3B is an enlarged cross-section view of an upper-middle portion of the gas separator of FIG. 2.
Figure 3C:
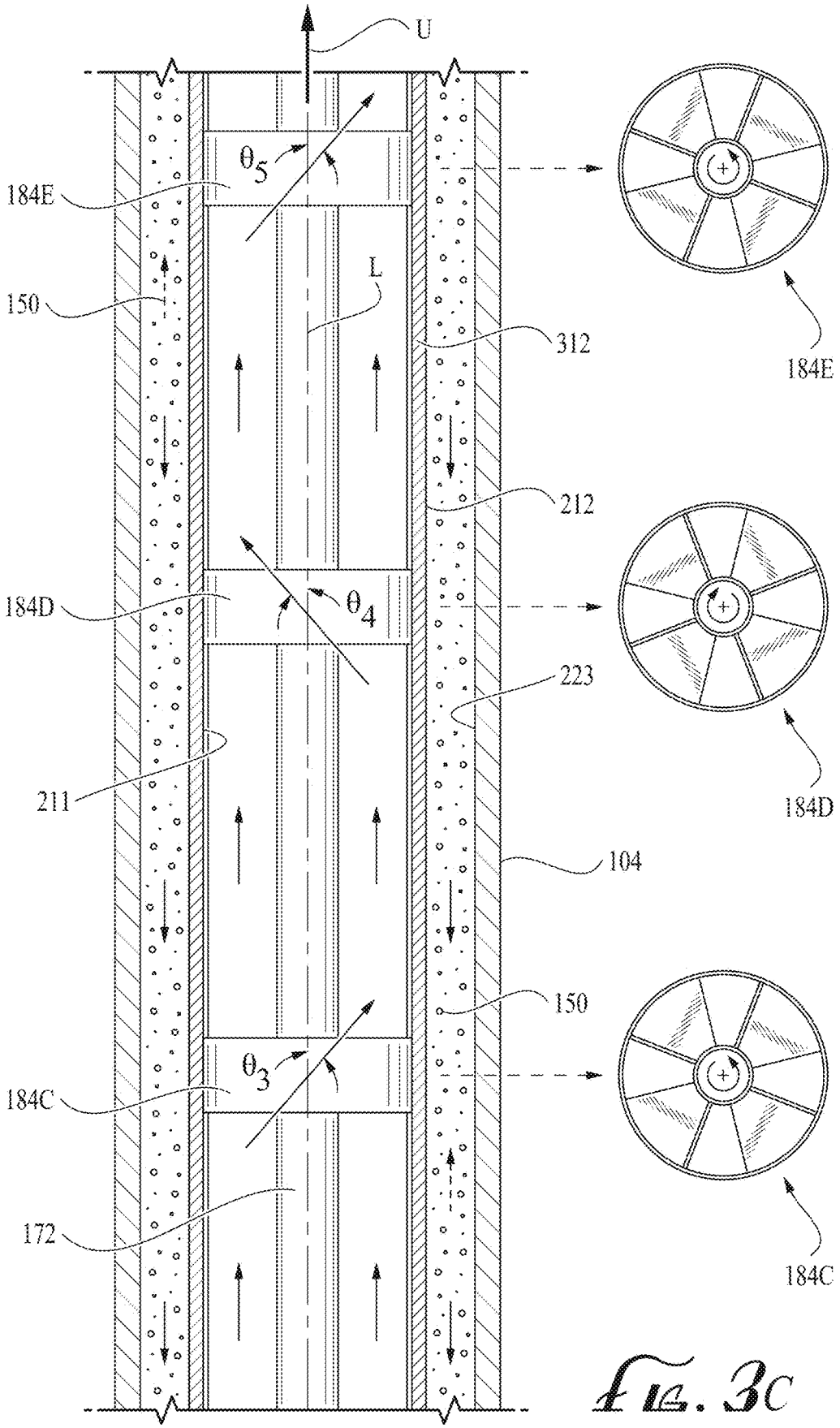
FIG. 3C is an enlarged cross-sectional view of a lower-middle portion of the gas separator of FIG. 2.
Figure 3D:
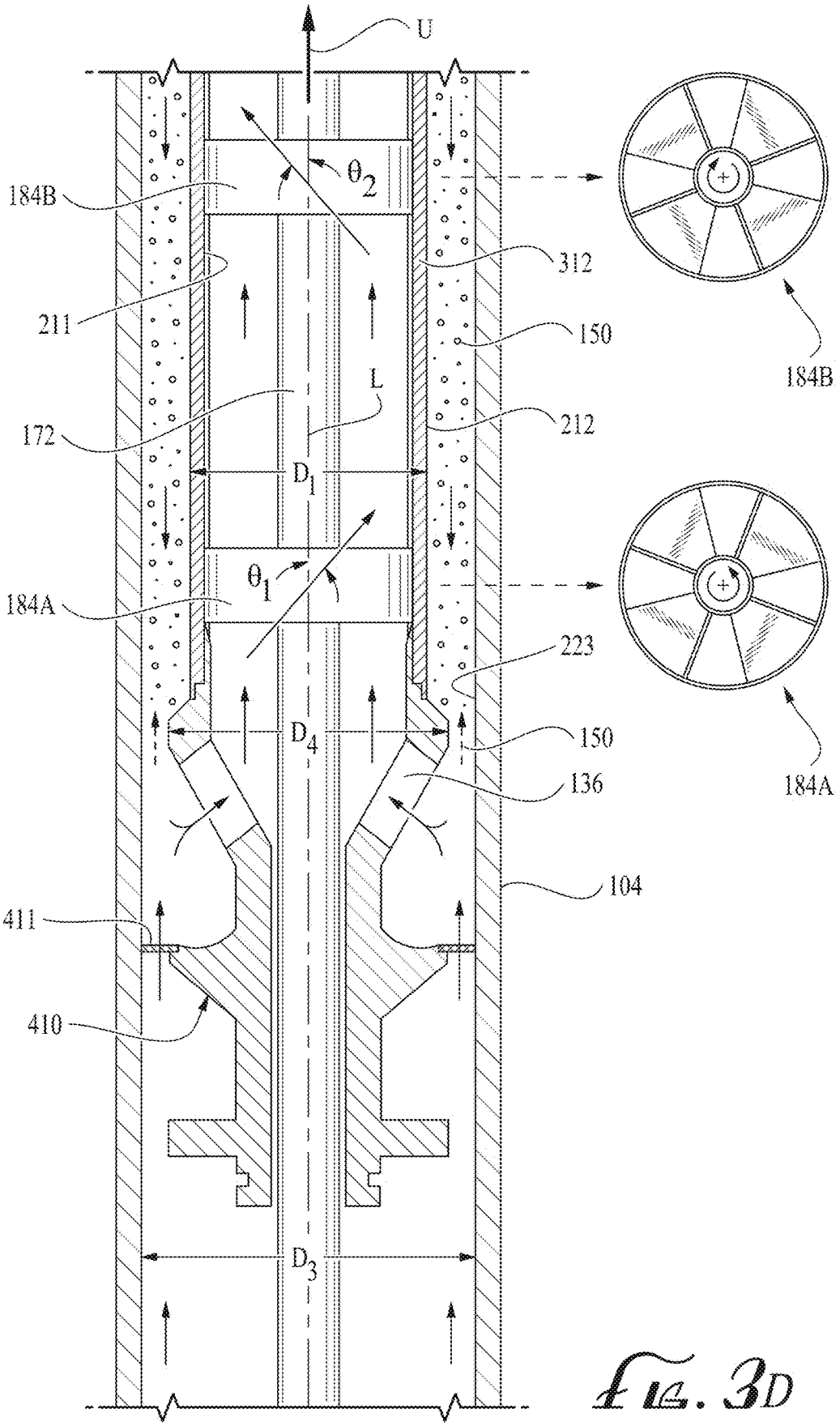
FIG. 3D is an enlarged cross-sectional view of a lower portion of the gas separator of FIG. 2.
Figure 4A:
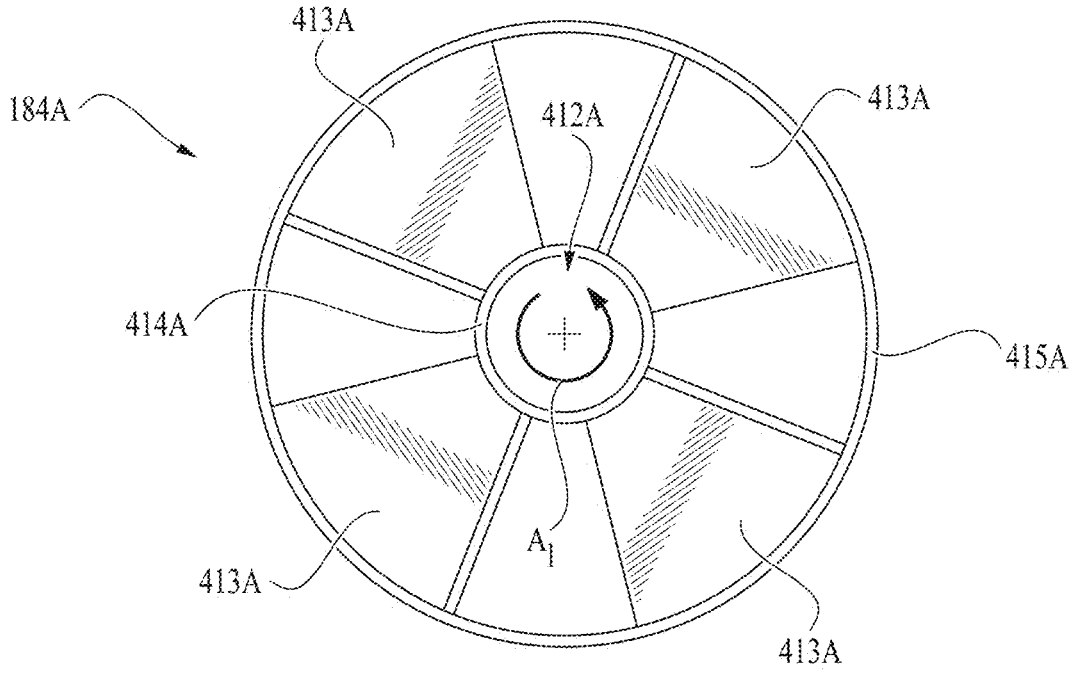
FIG. 4A is a top view of the first spider bearing of the gas separator of FIG. 2.
Figure 4B:
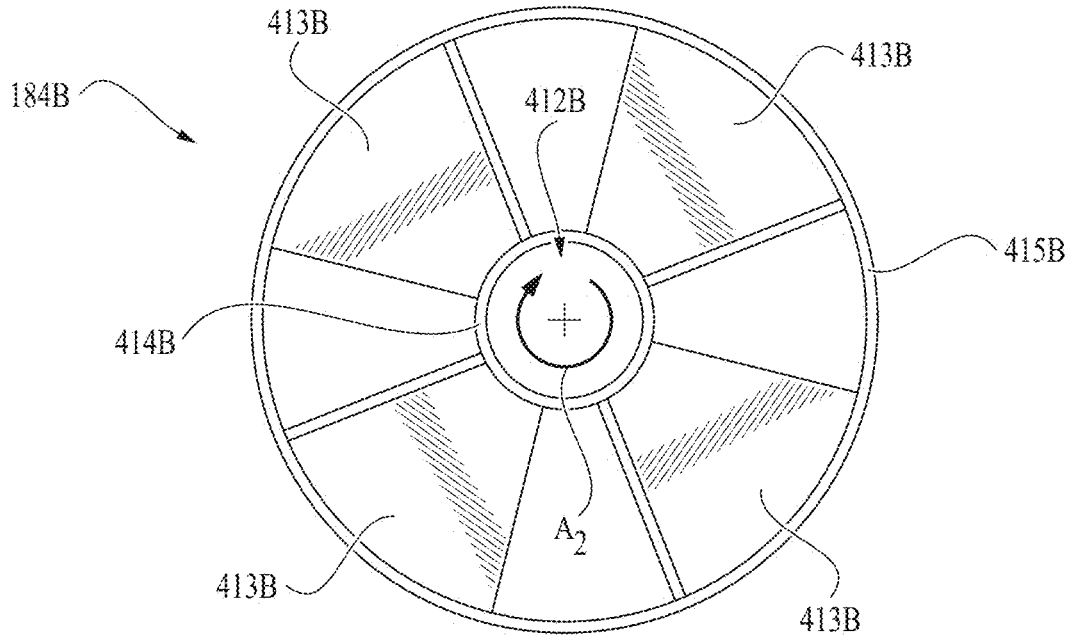
FIG. 4B is a top view of the second spider bearing of the gas separator of FIG. 2.
Figure 4C:
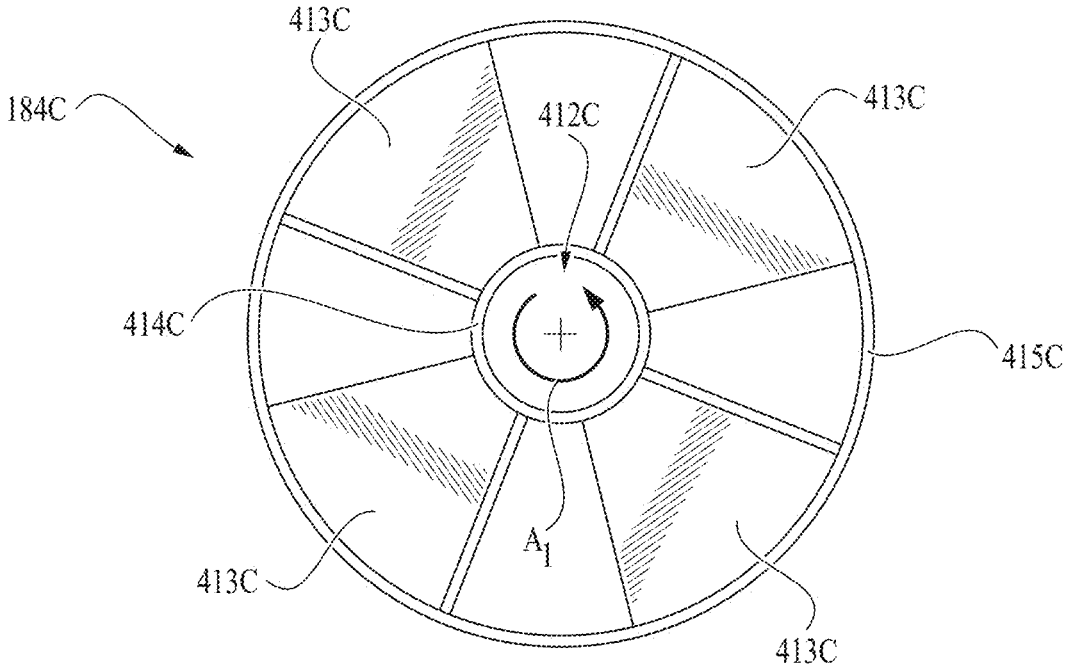
FIG. 4C is a top view of the third spider bearing of the gas separator of FIG. 2.
Figure 4D:
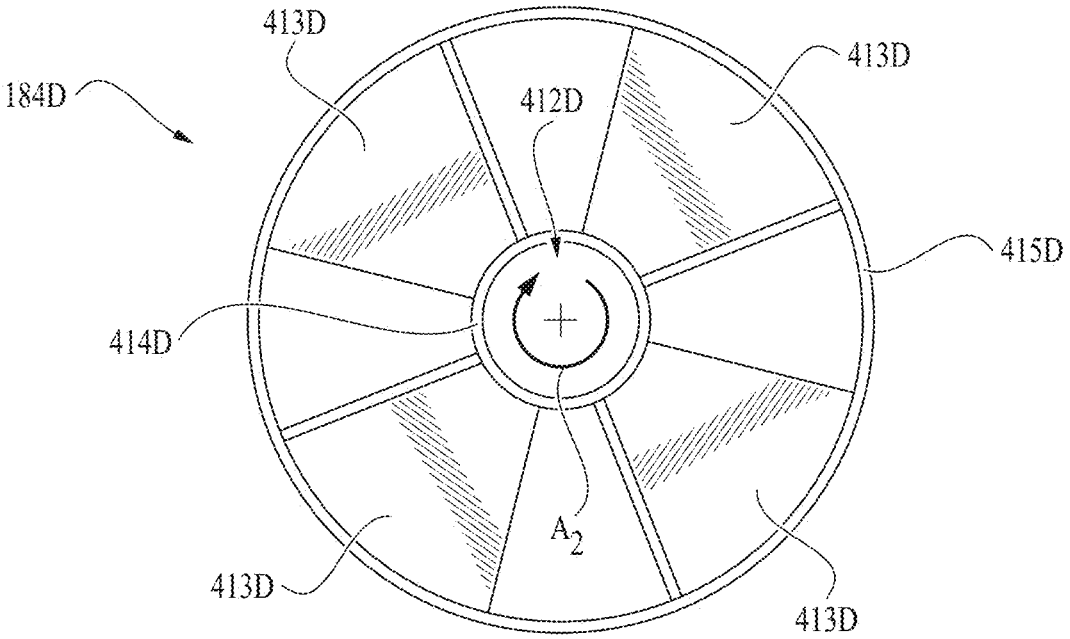
FIG. 4D is a top view of the fourth spider bearing of the gas separator of FIG. 2.
Figure 4E:
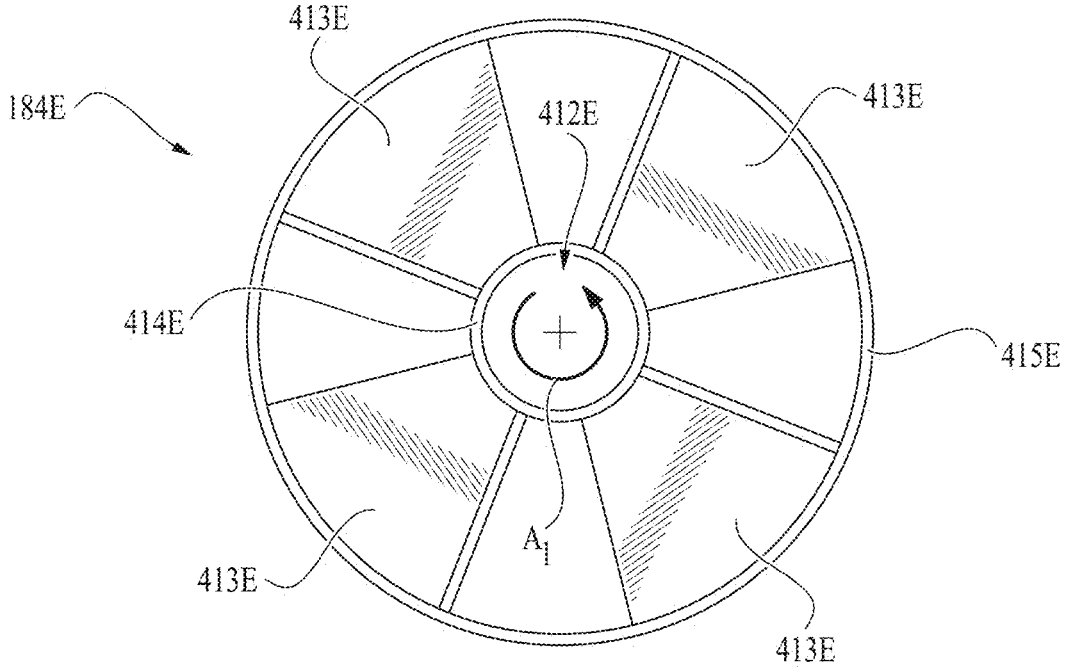
FIG. 4E is a top view of the fifth spider bearing of the gas separator of FIG. 2.

Referring to FIGS. 2-4, a gas separator 126 for an electric submersible pump (e.g., ESP assembly 132 of FIG. 1) may include an inlet (e.g., inlet ports 136); an outlet (e.g., gas phase discharge 314); a first portion 210 comprising a first inner circumferential surface 211 and a first outer circumferential surface 212 having a first diameter D1 (see FIG. 3D). The first portion 210 may be disposed between the inlet 136 and the outlet 314. The gas separator may further include a second portion 220 comprising a second inner circumferential surface 221 and a second outer circumferential surface 222 having a second diameter D2 (see FIG. 3B). The second portion 220 may be disposed between the first portion 210 and the outlet 314. The first diameter D1 may be less than the second diameter D2. For example, the first diameter D1 may be 3.38 inches and the second diameter may be 4 inches. In various embodiments, the first diameter D1 may be 15.5% smaller than the second diameter D2. In various embodiments, the first diameter D1 may be 10-20%, 5-30%, 1-15%, 15-50%, or 1-50% smaller than the second diameter D2. In various embodiments, the first diameter D1 is less than 95, 90, 85 or 80 percent of the second diameter. In various embodiments, the first portion may be 1 inch to 220 inches long.

Referring to FIG. 2, an annulus 217 of the first portion 210 may be disposed between the housing 312 and the casing 104. There may be a volume 218 of the first portion 210 inside the housing 312. An annulus 227 of the second portion 220 may be disposed between the housing 312 and the casing 104. There may be a volume 228 of the second portion 220 inside the housing 312. A volumetric flow rate in the uphole direction through the volume 218 may be equal to a volumetric flow rate in the uphole direction through the volume 228. A volumetric flow rate in the downhole direction through the annulus 227 may be equal to a volumetric flow rate in the downhole direction through the annulus 217. A flow velocity in a downhole direction through the annulus 227 may be greater than a flow velocity in the downhole direction through the annulus 217. Stated differently, a linear rate of flow in the downhole direction through the annulus 227 may be greater than a linear rate of flow in the downhole direction through the annulus 217.

Referring to FIGS. 2-4 some embodiments, the outlet 314 is part of or is fluidly coupled to a crossover 350 (e.g., a gas flow path and liquid flow path separator). The crossover 350 may comprise a plurality of channels or define a plurality of channels, for example, a gas phase discharge port 314 (a first pathway) and a liquid phase discharge port 316 (a second pathway). A gas phase 150 of the fluid may be discharged through the gas phase discharge port 314, and a liquid phase of the fluid may be discharged through the liquid phase discharge port 316. In some embodiments, either one or both of the gas phase discharge ports 314 and the one or more liquid phase discharge ports 316 may be defined by a channel or pathway having an opening, for example, a teardrop shaped opening, a round opening, an elliptical opening, a triangular opening, a square opening, or another shaped opening. Fluid expelled from the second pathway may be expelled from the liquid discharge port 316 partially upward and partially downward. In the meantime, separated gas (gas phase 150) from the annulus 217 may continually go upwards.

The gas separator 126 may further include a base 410. The inlet 136 may be formed in the base 410. The base 410 may include a screen 411 (e.g., for solid filtration). The base 410 may have a fourth diameter D4 that is greater than the first diameter (see FIG. 3D). In another embodiment, the fourth diameter D4 may be the same as the diameter of the first outer circumferential surface 212. The fourth diameter D4 may be a diameter proximate to where the base 410 is fastened to the first portion 210 (e.g., screwed onto the first portion 210). In some embodiments, the first portion 210 is a first portion of a tubular and the second portion 200 is a second portion of the tubular. In some embodiments, the gas separator 126 includes a coupling 510 disposed between the first portion 210 and the second portion 220. The coupling 510 may threadedly engage the first portion 210 and the second portion 220. That is, threads of the coupling 510 may engage threads of the first portion 210, and other threads of the coupling 510 may engage threads of the second portion 220. The first portion 210 may be part of or an entirety of a first tubular, and the second portion 220 may be part of or an entirety of a second tubular. The coupling may transition between the first diameter D1 and the second diameter D2. The coupling may be a bolted connection between the first diameter D1 and the second diameter D2. That is, the coupling 510 may comprise a chamfer or other feature for transitioning between the first diameter D1 at the first portion 210 and the second diameter D2 at the second portion 220.

The gas separator 126 may further include a shaft 172 extending axially through the first portion 210 and the second portion 220. The shaft 172 may be concentric with the first portion 210 and the second portion 220. Spider bearings 184 (see FIG. 5) may be affixed to the first inner circumferential surface 211 (see FIG. 1). Each of the spider bearings 184 may include a bore 412. The bore 412 may be formed in a first rim 414 (e.g., an inner rim). Vanes 413 may extend radially outward from the first rim 414 to a second rim 415 (e.g., an outer rim). The first rim 414 may be a ring, the second rim 415 may be a ring, and the first rim 414 may be concentric with the second rim 415. The first rim 414 may have the same axial length as the second rim 415. The shaft 172 may extend through the bore 412 of each of the spider bearings 184.

The vanes 413 may be configured to induce fluid inside a first volume V1 defined by the first inner circumferential surface 221 to flow in first tangential direction A1 (e.g., alternatively referred to as the first angular direction in some contexts) or a second tangential direction A2 (e.g., alternatively referred to as the second angular direction in some contexts). The first volume V1 may be the volume inside the first portion 210. The first tangential direction A1 may be counterclockwise about a longitudinal axis L of the shaft 172 as viewed from uphole. The second tangential direction A2 may be clockwise about the longitudinal axis L of the shaft 172 as viewed from uphole. The spider bearings 184 may be arranged in a pattern of alternating angular directions of the vanes 413. In other words, the spider bearings 184 may alternate based on the respective direction that they induce flow in. For example, the first spider bearing 184A may be configured to induce flow in the first tangential direction A1, the second spider bearing 184B may be configured to induce flow in the second tangential direction A2, the third spider bearing 184C may be configured to induce flow in the first tangential direction A1, the fourth spider bearing 184D may be configured to induce flow in the second tangential direction A2, and the fifth spider bearing 184E may be configured to induce flow in the first tangential direction A1. Alternatively, the first spider bearing 184A may be configured to induce flow in the second tangential direction A2, the second spider bearing 184B may be configured to induce flow in the first tangential direction A1, the third spider bearing 184C may be configured to induce flow in the second tangential direction A2, the fourth spider bearing 184D may be configured to induce flow in the first tangential direction A1, and the fifth spider bearing 184E may be configured to induce flow in the second tangential direction A2.

The gas separator 126 may further include a fluid mover (e.g., centrifugal pump stages 405) disposed inside a second volume V2 defined by the second inner circumferential surface 221. The second volume V2 may be the volume inside the second portion 220. The gas separator 126 may include an auger 302 disposed inside the second volume V2. The first portion 210 and the second portion 220 may be disposed inside a casing 104 that includes a third inner circumferential surface 223 having a third diameter D3 (see FIG. 3D). A difference between the third diameter D3 and the first diameter D1 may be greater than a difference between the third diameter D3 and the second diameter D2. A first cross-sectional area between the first outer circumferential surface 212 and the third inner circumferential surface 223 may be greater than a second cross sectional area between the second outer circumferential surface 222 and the third inner circumferential surface 223. The first cross sectional area may be uniform along an entire axial length of the first portion 210. That is, the first diameter D1 of the first outer circumferential surface 212 may be uniform along the entire length of the first portion 210, the second diameter D2 of the second outer circumferential surface 222 may be uniform along the entire length of the second portion 220, and the third diameter D3 of the third inner circumferential surface 223 of the casing 104 may be uniform along the entire length of the first portion 210 and the second portion 220. The second cross-sectional area may be uniform along an entire axial length of the second portion 220. The gas separator 126 may be configured such that an axial flow velocity along the first portion 210 in an annulus 105 (see FIG. 2) between the gas separator 126 and the casing 104 is less than an axial flow velocity along the second portion 220 in the annulus 105. The volumetric flow rate along the first portion 210 in the annulus 105 may be the same as the volumetric flow rate along the second portion 220 in the annulus 105.

In some embodiments, there may be fluid movers in the chamber defined by the first portion 210 (e.g., the first volume V1) in addition to or in combination with the spider bearings 184. For example, there could be two fluid movers, then a spider bearing, then two more fluid movers. The fluid movers may force fluid through spider bearings 184.

Referring to FIGS. 1-2 method of assembling an ESP 132 may include coupling the gas separator 126 to a centrifugal pump assembly 128 and a seal unit 124, and coupling the seal unit 124 to an electric motor 122. A method of lifting fluid in a wellbore 102 may include running the ESP 132 into a wellbore 102, and providing electric power to the electric motor 122.

Figure 6:
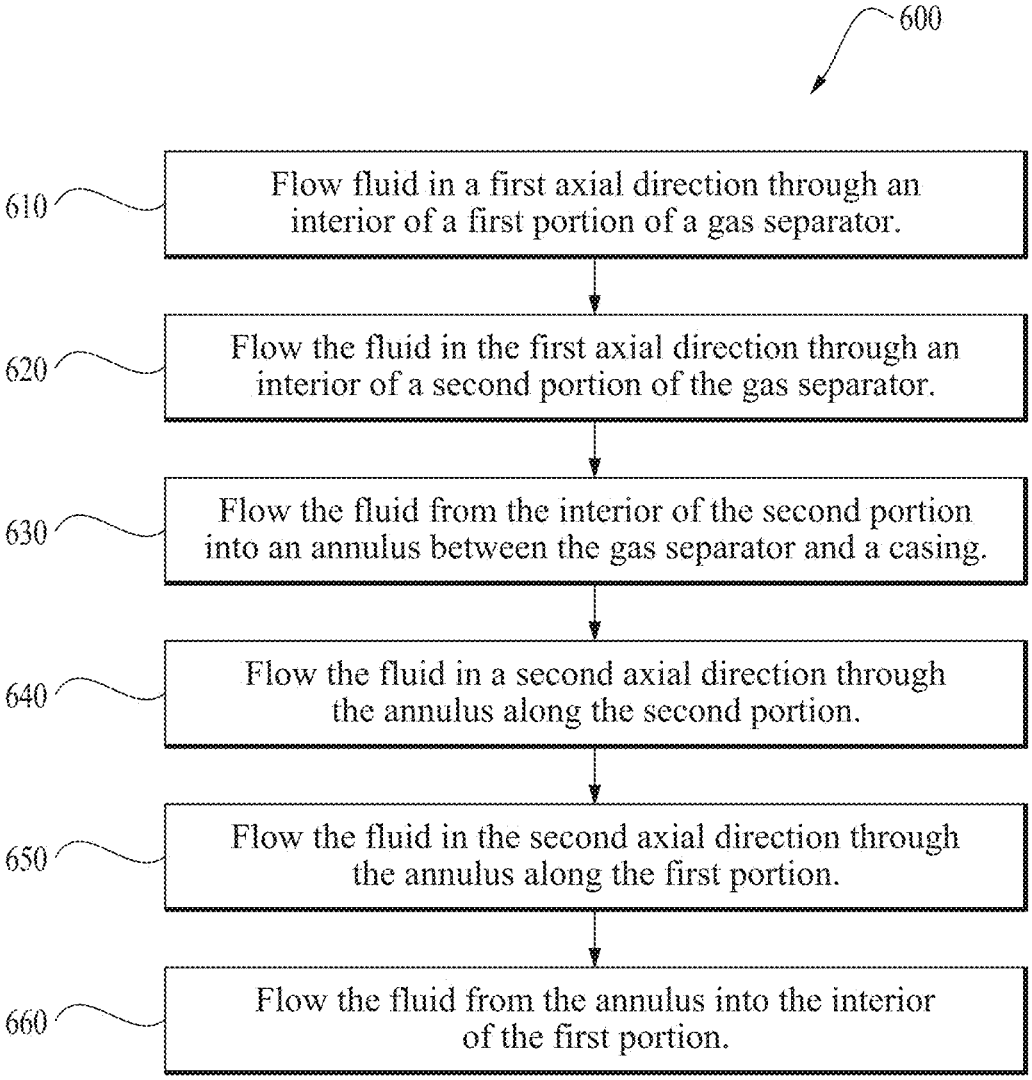
FIG. 6 is a flow diagram of a method of separating a gas phase from a liquid phase in fluid for pumping by an electric submersible pump, according to an embodiment.

Referring to FIG. 6, a method 600 of separating a gas phase from a liquid phase in fluid for pumping by an electric submersible pump may include the step 610 of flowing fluid in a first axial direction (e.g., in the uphole direction U, see FIG. 2) through an interior of a first portion of a gas separator (e.g., between the housing at the first portion and the shaft); the step 620 of flowing the fluid in the first axial direction through an interior of a second portion of the gas separator (e.g., between the housing at the second portion and the shaft); the step 630 of flowing the fluid from the interior of the second portion into an annulus between the gas separator and a casing (e.g., flowing the fluid through an outlet (e.g., gas phase discharge)); the step 640 of flowing the fluid (e.g., liquid) in a second axial direction through the annulus along the second portion (e.g., between the casing and the housing at the second portion), wherein the second axial direction is opposite to the first axial direction; the step 650 of flowing the fluid (e.g., liquid) in the second axial direction through the annulus along the first portion (e.g., between the casing and the housing at the first portion); and/or the step 660 of flowing the fluid from the annulus into the interior of the first portion (e.g., flowing the fluid through an inlet (e.g., inlet ports on a base affixed to the first portion of the housing)). A velocity of the fluid in the second axial direction (e.g., downhole) in the annulus along the second portion is greater than the velocity of the fluid in the second direction (e.g., downhole) in the annulus along the first portion (e.g., due to the cross sectional area of the annulus around the second portion being less than the cross sectional area of the annulus around the first portion).

The second axial direction may be opposite to the first axial direction. A volumetric flow rate of the fluid in the second axial direction in the annulus (e.g., the annulus between the housing and the casing) along the second portion may be the same as a volumetric flow rate of the fluid in the second axial direction in the annulus along the first portion, and a velocity of the fluid in the second axial direction in the annulus along the second portion may be greater than the velocity of the fluid in the second direction in the annulus along the first portion. That is, fluid flows relatively fast at locations in the annulus where the cross sectional area of the annulus is relatively small. Specifically, an annular cross-sectional area at the first portion may be greater than an annular cross-sectional area at the second portion.

The velocity of the fluid in the second direction in the annulus (e.g., between the gas separator and casing) along the first portion may be sufficiently low such that a buoyancy force on bubbles entrained in the fluid overcomes a drag force on the bubbles. The flowing of the fluid from the interior of the second portion into an annulus may include flowing the fluid through an outlet. The outlet may include a gas phase discharge. The flowing of the fluid from the annulus to the interior of the first portion may include flowing the fluid through an inlet. The inlet may include inlet ports. The inlet ports may be formed in a base.

At least some of bubbles may travel against the liquid phase in the first direction in the annulus to the surface. At least some of the bubbles may travel in the annulus in the second direction. The liquid phase may travel in the second direction in the annulus through the inlet. Some of the bubbles may also be drawn in through the inlet. The first portion may include a first outer circumferential surface having a first diameter, the second portion may include a second outer circumferential surface having a second diameter, and the first diameter may be less than the second diameter. This configuration may allow the buoyancy force of the bubbles in the uphole direction to overcome the drag force by the fluid on the bubbles in the downhole direction, thus enhancing gas phase separation.

Referring to FIGS. 2-4, a gas separator 126 for an electric submersible pump (e.g., the ESP assembly 132 of FIG. 1) may include a housing 312 and a shaft 172 extending through the housing 312. The shaft 172 may be concentrically disposed with respect to the housing 312. A first spider bearing 184A may be affixed to the housing 312 (e.g., in the first volume V1) and may include first vanes 413A. The shaft 172 may extend through a first bore 412A in the first spider bearing 184A. A second spider bearing 184B may be affixed to the housing 312 (e.g., in the first volume) and may comprise second vanes 413B. The shaft 172 may extend through a second bore 412B in the second spider bearing 184B. A sign (e.g., positive or negative) of a first pitch angle $\theta_1$ of the first vanes 413A may be opposite to a sign (e.g., negative or positive) of a second pitch angle $\theta_2$ of the second vanes 413B. The first pitch angle $\theta_1$ and the second pitch angle $\theta_2$ may be with respect to an uphole direction U parallel to a longitudinal axis L of the shaft 172. In some embodiments, the sign of the first pitch angle $\theta_1$ is positive according to a right-handed convention, and the sign of the second pitch angle $\theta_2$ is negative according to the right-handed convention.

Figure 5:
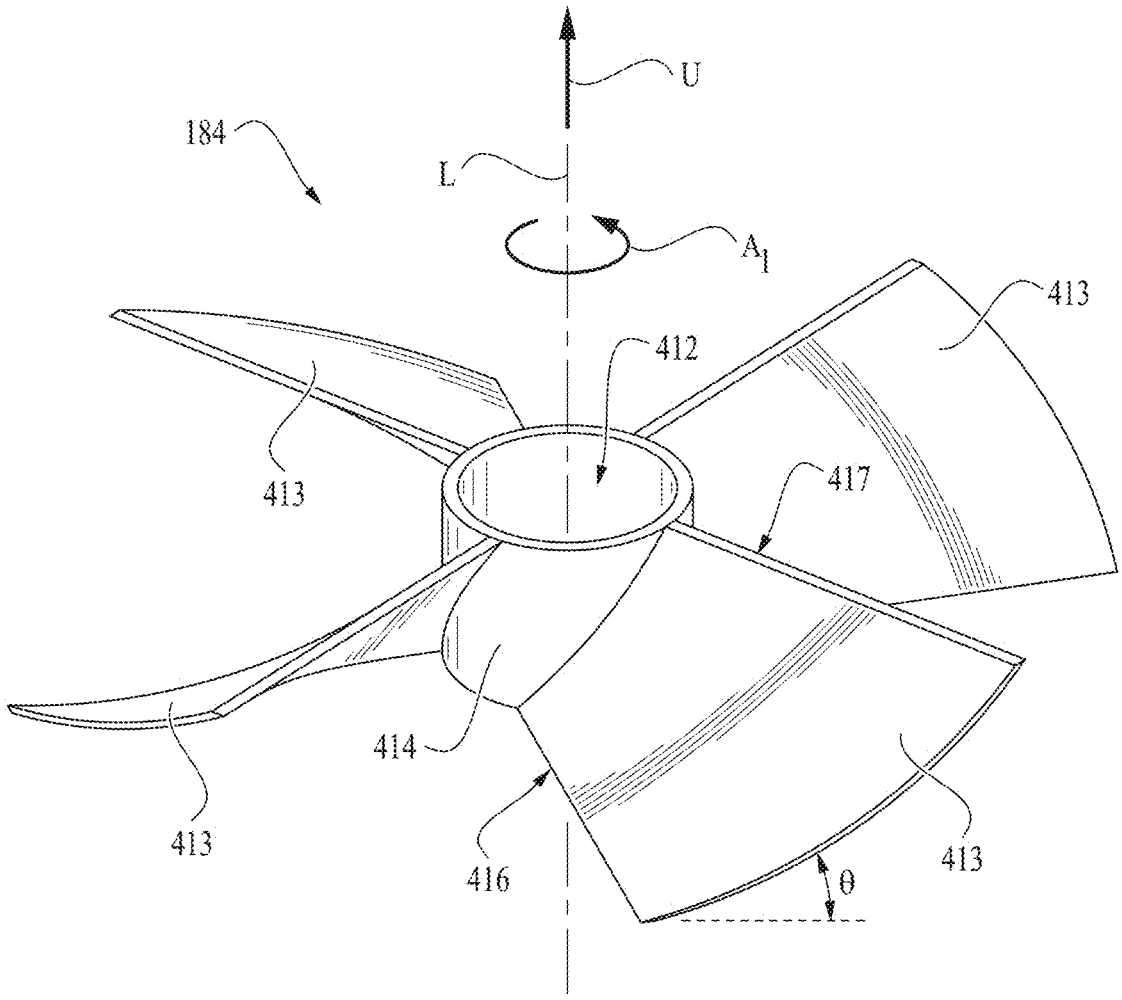
FIG. 5 is perspective view of a spider bearing with the outer rim omitted for clarity, according to an embodiment.

In more detail, referring to FIG. 5, when fingers of the right hand are curled from leading edge 416 to trailing edge 417 of the vanes 413, the direction of the thumb relative to the uphole direction U indicates the sign of vanes 413. The uphole direction U may be a vector pointing uphole that is parallel to the longitudinal axis L of the shaft. As an example, in FIG. 5 the pitch angle of the vanes 413 of the spider bearing 184 is positive; the direction from leading edge 416 to trailing edge 417 curls counterclockwise around the longitudinal axis L, and thus according to the right-hand convention, the pitch angle is positive. In FIG. 5, the outer rim is omitted for clarity. The vanes may have a pitch angle $\theta$ (e.g., 45 degrees, 40-50 degrees, or 30-60 degrees).

In some embodiments, the pitch angle of the first spider bearing 184A is 45 degrees according to the right-handed convention and/or the pitch angle of the second bearing 184B is −45 degrees according to the right-hand convention. For example, referring to FIGS. 3D and 4, when viewed from the side, the angle $\theta_1$ formed between the first vanes 413A and the longitudinal axis L is 45 degrees; and when viewed from the side, the angle $\theta_2$ formed between the second vane 413B and the longitudinal axis L is −45 degrees.

In other embodiments, the first pitch angle is −45 degrees according to the right-hand convention, and the second pitch angle is 45 degrees according to the right-hand convention. In various embodiments, any one or more of the pitch angles could be ±40-50 degrees, ±30-60 degrees, ±20-70 degrees, ±10-80 degrees, and/or a variable pitch angle.

Referring to FIG. 3C, in some embodiments, the gas separator 126 further includes a third spider bearing 184C affixed to the housing 312 and comprising third vanes 413C. The shaft 172 may extend through a third bore 412C in the third spider bearing 184C. A sign of a third pitch angle $\theta_3$ of the third vanes 413C may be opposite to a sign of the second pitch angle $\theta_3$. For example, the third pitch angle $\theta_3$ may be 45 degrees. In some embodiments, the gas separator 126 further includes a fourth spider bearing 184D affixed to the housing 312 and comprising fourth vanes 413D. The shaft 172 may extend through a fourth bore 412D in the fourth spider bearing 184D. A sign of a fourth pitch angle $\theta_4$ of the fourth vanes 413D may be opposite to a sign of the third pitch angle $\theta_3$. For example, the fourth pitch angle $\theta_4$ may be −45 degrees. In some embodiments, the gas separator 126 further includes a fifth spider bearing 184E is affixed to the housing 312 and comprising fifth vanes 413E. The shaft 172 may extend through a fifth bore 412E in the fifth spider bearing 184E. A sign of a fifth pitch angle $\theta_5$ of the fifth vanes 413E is opposite to a sign of the fourth pitch angle $\theta_4$. For example, the sign of the fifth pitch angle $\theta_5$ may be 45 degrees. The alternating of the direction of the vanes 413 of the spider bearings 184 may enhance the amount of turbulence created which may improve effectiveness at breaking down bubbles so that fluid movers can better handle the fluid.

There may be any number of spider bearings in any suitable orientation. The sign (e.g., direction) of the vanes 413 may alternate at every spider bearing 184, at every two spider bearings 184, at every three spider bearings 184, or the spider bearings 184 may alternate direction in an irregular pattern (e.g., two spider bearings 184 may have a positive pitch angle, the next two spider bearings 184 may have a negative pitch angle, the next spider bearing 184 may have a positive pitch angle, and the next spider bearing 184 may have a negative pitch angle.

There may be bushings keyed to the shaft 172, and the spider bearings 184 may act as journal bearings. A fluid film between the bushings and the spider bearings 184 may cool and/or reduce wear on these components.

Although the spider bearings 184 are depicted as having four vanes 413, in some embodiments, the spider bearings 184 have one, two, three, five, six, seven, eight, nine, ten, eleven, twelve, or more vanes. In some embodiments, the spider bearings 184 near the inlet 136 may have a different number of vanes than the spider bearings 184 near the outlet 314. For example, the first spider bearing 184A may have three vanes, the second spider bearing 184B may have four vanes, the third spider bearing 184C may have five vanes, the fourth spider bearing 184D may have six vanes, and the fifth spider bearing 184E may have seven vanes.

The gas separator 126 may further include a base 410 affixed to the housing 312. Inlet ports 136 may be formed in the base 410. The gas separator 126 may further include a fluid mover (e.g., centrifugal pump stages 405) disposed in the housing (e.g., in the second volume V2). The first spider bearing 184A, the second spider bearing 184B, the third spider bearing 184C, the fourth spider bearing 184D, and/or the fifth spider bearing 184E may be disposed between the base 410 and the centrifugal pumps stages 405. A gas phase discharge 314 may be formed in the housing 312. The gas separator 126 may further include an auger 302 disposed in the housing 312. The auger 302 may be disposed between the centrifugal pump stages 405 and the gas phase discharge 314.

In some embodiments, the housing 312 comprises a first portion 210 and a second portion 220. The first portion 210 of the housing 312 may be distinguished from the second portion 220 of the housing 312 in that the second portion 220 may have a smaller outer diameter than the first portion 210.

The first spider bearing 184A, the second spider bearing 184B, the third spider bearing 184C, the fourth spider bearing 184D, and/or the fifth spider bearing 184E may be disposed inside the first portion 220. That is, the spider bearings 184 may be disposed inside the housing 312 along an axial length of the housing 312 defined as the first portion 210. The fluid mover (e.g., centrifugal pump stages 405) may be disposed in the second portion 220. That is, the fluid mover may be disposed inside the housing 312 along an axial length of the housing 312 defined as the second portion 220. An outer diameter D1 of the first portion 210 may be less than an outer diameter D2 of the second portion 220. In some embodiments, the first portion 210 is a first portion of a tubular and the second portion is a second portion 220 of the tubular. In some embodiments, there may be a coupling 510 disposed between the first portion 210 and the second portion 220. The coupling 510 may engage (e.g., by threads or bolts) the first portion 210 and the second portion 220. The first portion 210 may be part of or an entirety of a first tubular and/or the second portion 220 may be part of or an entirety of a second tubular. The gas separator 126 may be configured to be disposed inside a casing 104 of the wellbore.

Referring to FIGS. 1-2, a method of assembling an ESP 132 may include coupling the gas separator 126 to a centrifugal pump assembly 128 and a seal unit 124, and coupling the seal unit 124 to an electric motor 122. A method of lifting fluid in a wellbore 102 may include running the ESP 132 into a wellbore 102, and providing electric power to the electric motor 122.

Figure 7:
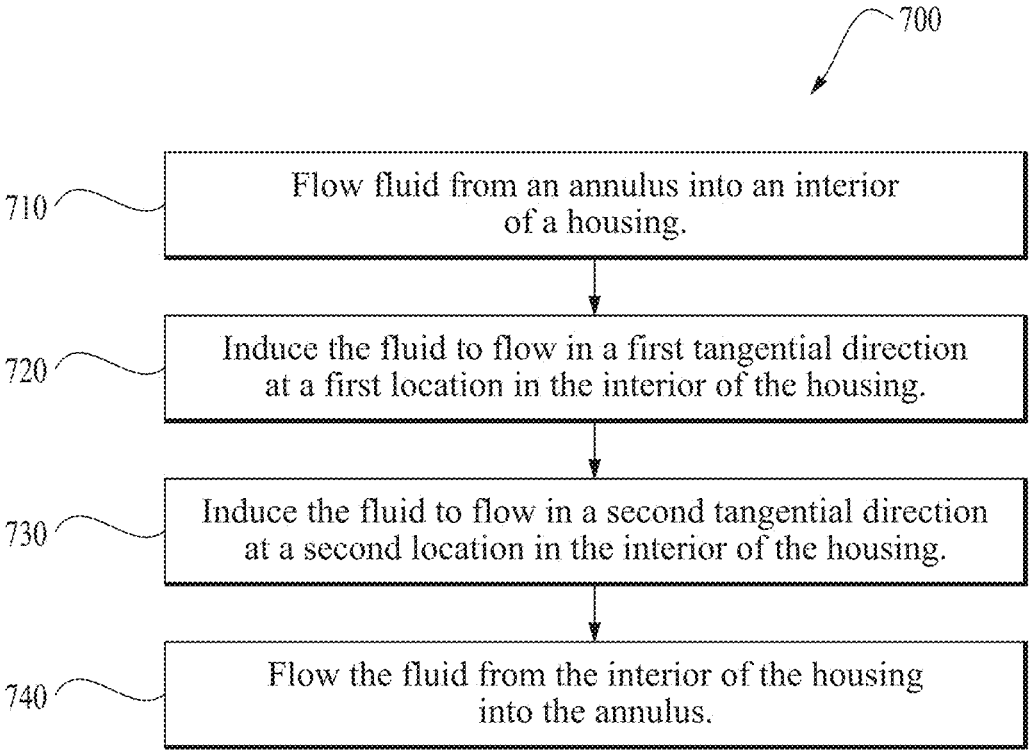
FIG. 7 is a flow diagram of a method of reducing bubble size in fluid for pumping by an electric submersible pump.

Referring to FIG. 7, a method 700 of reducing bubble size in fluid for pumping by an electric submersible pump may include the step 710 of flowing fluid from an annulus (e.g., between a casing and a housing of a gas separator) into an interior of a housing (e.g., through inlet ports); the step 720 of inducing the fluid to flow in a first tangential direction (e.g., counterclockwise) at a first location (e.g. at an element proximate to an intake of the gas separator) in the interior of the housing; the step 730 of inducing the fluid to flow in a second tangential direction (e.g., clockwise) at a second location (e.g., at another element closer to the gas phase discharge) in the interior of the housing, wherein the first tangential direction is opposite to the second tangential direction, and wherein the first location and the second location are axially spaced apart; and the step 740 of flowing the fluid from the interior of the housing into the annulus (e.g., through a gas phase discharge), wherein the inducing of the fluid to flow in the first tangential direction and the inducing of the fluid to flow in the second tangential direction promotes turbulence (e.g. by alternating the tangential velocity of the fluid inside the gas separator) in the interior of the housing, and wherein the turbulence promotes reduction in size of bubbles in the fluid (e.g., by breaking large bubbles into smaller bubbles).

The inducing of the fluid to flow may be performed by a turbulence inducer. The turbulence inducers may be oriented in different directions to enhance the amount of turbulence created. The turbulence inducer could be, for example, a seal comprising a hole, a baffle, a sieve, or a spider bearing. The turbulence may be induced between a fluid intake and a fluid mover. The device (e.g., spider bearing) used to induce the turbulence may cause a Reynold's number to be increased in the zone of the device. The Reynolds number may increase moving uphole within the gas separator. The increased Reynold's number may cause a reduction in bubble size. When spider vanes are used, the spider vanes may constrain the shaft from moving radially in addition to promoting turbulence.

The inducing of the rotation of the fluid may cause the fluid to flow outside (e.g., radially outward) and the gas to stay on the inside (e.g., radially inward). The spider bearings may induce the fluid to change direction, thus increasing turbulence. In some embodiments, the turbulence inside the first portion is greater than the turbulence in the annulus along the first portion. In some embodiments, the bubble size at a downhole end of an interior of the first portion is greater than a bubble size at an uphole end of the interior of the first portion. In some embodiments, there is significant turbulence at the inlet ports.

The method 700 may further include inducing the fluid to flow in the first tangential direction at a third location inside the housing (e.g., by a third element (e.g., spider bearing)). The third location may be spaced axially apart from the second location. The second location may be disposed between the first location and the third location. The method 700 may further include inducing the fluid to flow in the second tangential direction at a fourth location inside the housing (e.g., by a fourth element (e.g., spider bearing)). The fourth location may be axially spaced apart from the third location. The second location and the third location may be disposed between the first location and the fourth location. The method 700 may further include inducing the fluid to flow in the first tangential direction at a fifth location inside the housing (e.g., by a fifth element (e.g., spider bearing)). The fifth location may be axially spaced apart from the fourth location. The second location, the third location, and the fourth location may be disposed between the first location and the fifth location. The fifth location may be proximate to the gas phase discharge.

The fluid may be produced from a well and may be processed by the gas separator. The flowing of the fluid from the annulus to inside the housing may include flowing fluid through inlet ports of a base. In some embodiments, the first tangential direction is clockwise as viewed from uphole, and the second tangential direction is counterclockwise as viewed from uphole. In some embodiments, the first tangential direction is counterclockwise as viewed from uphole, and the second tangential direction is clockwise as viewed from uphole.

The spider bearings may be affixed to the housing. A shaft may extend through a bore of each spider bearing. Each spider bearing may include vanes. A sign of a first pitch angle of the vanes of a first spider bearing may be opposite to a sign of a second pitch angle of vanes of a second spider bearing. This pattern may repeat along the interior of the gas separator (e.g., in the first volume and/or along the first portion of the gas separator). The first pitch angle and the second pitch angle may be with respect to an uphole direction parallel to a longitudinal axis of the shaft.

According to the systems and methods disclosed herein, the first portion having a smaller outer diameter than the second portion may reduce drag force of bubbles in the annulus, thus improving gas phase separation from the liquid phase as compared with the conventional art. Additionally, according to the systems and methods disclosed herein, the inducing of tangential flow in alternate directions inside the gas separator (e.g., by the spider bearings with alternating vane directions) may cause reduction in bubble size, thus improving processing by fluid movers (e.g., centrifugal pump stages) as compared with the conventional art. These two configurations may be used individually or together to improve overall performance (e.g., improve pumping efficiency and/or reduce power consumption) of the ESP as compared with the conventional art.

ADDITIONAL DISCLOSURE

The following are non-limiting, specific embodiments in accordance with the present disclosure:

In a first embodiment, a gas separator for an electric submersible pump comprises an inlet; an outlet; a first portion comprising a first inner circumferential surface and a first outer circumferential surface having a first diameter, wherein the first portion is disposed between the inlet and the outlet; and a second portion comprising a second inner circumferential surface and a second outer circumferential surface having a second diameter, wherein the second portion is disposed between the first portion and the outlet, wherein the first diameter is less than the second diameter.

A second embodiment can include the gas separator of the first embodiment, wherein the inlet comprises inlet ports.

A third embodiment can include the gas separator of the first or second embodiments, wherein the outlet comprises a gas phase discharge disposed uphole with respect to the inlet ports.

A fourth embodiment can include the gas separator of any of the first through third embodiments, further comprising a base, wherein the inlet is formed in the base.

A fifth embodiment can include the gas separator of any of the first through fourth embodiments, wherein the base comprises a screen.

A sixth embodiment can include the gas separator of any of the first through fifth embodiments, wherein the base has a third diameter that is greater than the first diameter.

A seventh embodiment can include the gas separator of any of the first through third embodiments, wherein the first portion is a first portion of a tubular and the second portion is a second portion of the tubular.

An eighth embodiment can include the gas separator of any of the first through third and seventh embodiments, further comprising a coupling disposed between the first portion and the second portion, wherein the coupling threadedly engages the first portion and the second portion, wherein the first portion is part of or an entirety of a first tubular, and the second portion is part of or an entirety of a second tubular.

A ninth embodiment can include the gas separator of any of the first through eighth embodiments, further comprising a shaft extending axially through the first portion and the second portion.

A tenth embodiment can include the gas separator of any of the first through ninth embodiments, further comprising spider bearings affixed to the first inner circumferential surface, wherein each of the spider bearings comprises a bore, and wherein the shaft extends through the bore of each of the spider bearings.

An eleventh embodiment can include the gas separator of any of the first through tenth embodiments, wherein each of the spider bearings comprises vanes configured to induce fluid inside a first volume defined by the first inner circumferential surface to flow in first tangential direction or a second tangential direction.

A twelfth embodiment can include the gas separator of any of the first through eleventh embodiments, wherein the spider bearings are arranged in a pattern of alternating angular directions of the vanes.

A thirteenth embodiment can include the gas separator of any of the first through twelfth embodiments, further comprising a fluid mover disposed inside a second volume defined by the second inner circumferential surface.

A fourteenth embodiment can include the gas separator of any of the first through thirteenth embodiments, wherein the fluid mover comprises one or more centrifugal pump stages.

A fifteenth embodiment can include the gas separator of any of the first through fourteenth embodiments, further comprising an auger disposed inside the second volume.

A sixteenth embodiment can include the gas separator of any of the first through fifteenth embodiments, wherein the first portion and the second portion are configured to be disposed inside a casing comprising a third inner circumferential surface having a third diameter, wherein a difference between the third diameter and the first diameter is greater than a difference between the third diameter and the second diameter.

A seventeenth embodiment can include the gas separator of any of the first through sixteenth embodiments, wherein the first portion and the second portion are configured to be disposed inside a casing comprising a third inner circumferential surface, wherein a cross sectional area between the first outer circumferential surface and the third inner circumferential surface is greater than a cross sectional area between the second outer circumferential surface and the third inner circumferential surface.

An eighteenth embodiment can include the gas separator of any of the first through seventeenth embodiments, wherein the first cross sectional area is uniform along an entire axial length of the first portion, and wherein the second cross sectional area is uniform along an entire axial length of the second portion.

A nineteenth embodiment can include the gas separator of any of the first through eighteenth embodiments, wherein the gas separator is configured such that an axial flow rate along the first portion in an annulus between the gas separator and the casing is less than an axial flow rate along the second portion in the annulus.

In a twentieth embodiment, a method of assembling an electric submersible pump comprises coupling the gas separator of any of the first through nineteenth embodiments to a centrifugal pump assembly and a seal unit; and coupling the seal unit to an electric motor.

In a twenty-first embodiment, a method of lifting fluid in a wellbore comprises running the electric submersible pump of any of the first through twentieth embodiments into a wellbore; and providing electric power to the electric motor.

In a twenty-second embodiment, a method of separating a gas phase from a liquid phase in fluid for pumping by an electric submersible pump comprises flowing fluid in a first axial direction through an interior of a first portion of a gas separator; flowing the fluid in the first axial direction through an interior of a second portion of the gas separator; flowing the fluid from the interior of the second portion into an annulus between the gas separator and a casing; flowing the fluid in a second axial direction through the annulus along the second portion, wherein the second axial direction is opposite to the first axial direction; flowing the fluid in the second axial direction through the annulus along the first portion; flowing fluid from the annulus to the interior of the first portion, wherein a volumetric flow rate in the second axial direction of the fluid in the annulus along the second portion is the same as a volumetric flow rate in the second axial direction of the fluid in the annulus along the first portion, and/or wherein a velocity in the second axial direction of the fluid in the annulus along the second portion is greater than the velocity in the second direction of the fluid in the annulus along the first portion.

A twenty-third embodiment can include the method of the twenty-second embodiment, wherein the velocity in the second direction of the fluid in the annulus along the first portion is sufficiently low such that a buoyancy force on bubbles entrained in the fluid overcomes a drag force on the bubbles.

A twenty-fourth embodiment can include the method of the twenty-second or twenty-third embodiments, wherein the flowing of the fluid from the interior of the second portion into an annulus comprises flowing the fluid through an outlet.

A twenty-fifth embodiment can include the method of any of the twenty-second through twenty-fourth embodiments, wherein the outlet comprises a gas phase discharge.

A twenty-sixth embodiment can include the method of any of the twenty-second through twenty-fifth embodiments, wherein the flowing of the fluid from the annulus to the interior of the first portion comprise flowing the fluid through an inlet.

A twenty-seventh embodiment can include the method of any of the twenty-second through twenty-sixth embodiments, wherein the inlet comprises inlet ports.

A twenty-eighth embodiment can include the method of any of the twenty-second through twenty-seventh embodiments, wherein the inlet ports are formed in a base.

A twenty-ninth embodiment can include the method of any of the twenty-second through twenty-eighth embodiments, wherein the fluid comprises bubbles, and at least some of bubbles travel in the first direction in the annulus to surface.

A thirtieth embodiment can include the method of any of the twenty-second through twenty-ninth embodiments, wherein the fluid comprises liquid, and the liquid travels in the second direction in the annulus through the inlet.

A thirty-first embodiment can include the method of any of the twenty-second through thirtieth embodiments, wherein the first portion comprises a first outer circumferential surface having a first diameter, the second portion comprises a second outer circumferential surface having a second diameter, and the first diameter is less than the second diameter.

In a thirty-second embodiment, a gas separator for an electric submersible pump comprises a housing; a shaft extending through the housing, wherein the shaft is concentrically disposed with respect to the housing; a first spider bearing affixed to the housing and comprising first vanes, wherein the shaft extends through a first bore in the first spider bearing; a second spider bearing affixed to the housing and comprising second vanes, wherein the shaft extends through a second bore in the second spider bearing, wherein a sign of a first pitch angle of the first vanes is opposite to a sign of a second pitch angle of the second vanes, and wherein the first pitch angle and the second pitch angle are with respect to an uphole direction parallel to a longitudinal axis of the shaft.

A thirty-third embodiment can include the gas separator of the thirty-second embodiment, wherein the sign of the first pitch angle is positive according to a right-handed convention, and the sign of the second pitch angle is negative according to the right-handed convention.

A thirty-fourth embodiment can include the gas separator of the thirty-second or thirty-third embodiments, wherein the first pitch angle is 45 degrees according to the right-handed convention, and the second pitch angle is −45 degrees according to the right-hand convention.

A thirty-fifth embodiment can include the gas separator of the thirty-second embodiment, wherein the sign of the first pitch angle is negative according to a right-handed convention, and the sign of the second pitch angle is positive according to the right handed-convention.

A thirty-sixth embodiment can include the gas separator of the thirty-second or thirty-fifth embodiments, wherein the first pitch angle is −45 degrees according to the right-hand convention, and wherein the second pitch angle is 45 degrees according to the right-hand convention.

A thirty-seventh embodiment can include the gas separator of any of the thirty-second through thirty-sixth embodiments, further comprising a third spider bearing affixed to the housing and comprising third vanes, wherein the shaft extends through a third bore in the third spider bearing, and wherein a sign of a third pitch angle of the third vanes is opposite to a sign of the second pitch angle.

A thirty-eighth embodiment can include the gas separator of any of the thirty-second through thirty-seventh embodiments, further comprising a fourth spider bearing affixed to the housing and comprising fourth vanes, wherein the shaft extends through a fourth bore in the fourth spider bearing, and wherein a sign of a fourth pitch angle of the fourth vanes is opposite to a sign of the third pitch angle.

A thirty-ninth embodiment can include the gas separator of any of the thirty-second through thirty-eighth embodiments, further comprising a fifth spider bearing affixed to the housing and comprising fifth vanes, wherein the shaft extends through a fifth bore in the fifth spider bearing, and wherein a sign of a fifth pitch angle of the fifth vanes is opposite to a sign of the fourth pitch angle.

A fortieth embodiment can include the gas separator of any of the thirty-second through thirty-ninth embodiments, further comprising a base affixed to the housing, wherein inlet ports are formed in the base.

A forty-first embodiment can include the gas separator of any of the thirty-second through fortieth embodiments, further comprising a fluid mover disposed in the housing.

A forty-second embodiment can include the gas separator of any of the thirty-second through forty-first embodiments, wherein the fluid mover comprising centrifugal pump stages.

A forty-third embodiment can include the gas separator of any of the thirty-second through forty-second embodiments, wherein the first spider bearing and the second spider bearing are disposed between the base and the centrifugal pumps stages.

A forty-fourth embodiment can include the gas separator of any of the thirty-second through forty-third embodiments, further comprising a gas phase discharge formed in the housing.

A forty-fifth embodiment can include the gas separator of any of the thirty-second through forty-fourth embodiments, further comprising an auger disposed in the housing, wherein the auger is disposed between the centrifugal pump stages and the gas phase discharge.

A forty-sixth embodiment can include the gas separator of any of the thirty-second through forty-fifth embodiments, wherein the housing comprises a first portion and a second portion, the first spider bearing and the second spider bearing are disposed in the first portion, the fluid mover is disposed in the second portion, and an outer diameter of the first portion is less than an outer diameter of the second portion.

A forty-seventh embodiment can include the gas separator of any of the thirty-second through forty-sixth embodiments, wherein the first portion is a first portion of a tubular and the second portion is a second portion of the tubular.

A forty-eighth embodiment can include the gas separator of any of the thirty-second through forty-sixth embodiments, further comprising a coupling disposed between the first portion and the second portion, wherein the coupling threadedly engages the first portion and the second portion, wherein the first portion is part of or an entirety of a first tubular, and the second portion is part of or an entirety of a second tubular.

A forty-ninth embodiment can include the gas separator of any of the thirty-second through forty-eighth embodiments, wherein the gas separator is configured to be disposed inside a casing of a wellbore.

In a fiftieth embodiment, a method of assembling an electric submersible pump comprises coupling the gas separator of any of the thirty-second through forty-ninth embodiments to a centrifugal pump assembly and a seal unit; and coupling the seal unit to an electric motor.

In a fifty-first embodiment, a method of lifting fluid in a wellbore comprises running the electric submersible pump of any of the thirty-second through fiftieth embodiments into a wellbore; and providing electric power to the electric motor.

In a fifty-second embodiment, a method of reducing bubble size in fluid for pumping by an electric submersible pump comprises flowing fluid from an annulus to inside a housing; inducing the fluid to flow in a first tangential direction at a first location inside the housing; inducing the fluid to flow in a second tangential direction at a second location inside the housing, wherein the first tangential direction is opposite to the second tangential direction, and wherein the first location and the second location are axially spaced apart; and flowing fluid from inside the housing to the annulus, wherein the inducing of the fluid to flow in the first tangential direction and the inducing of the fluid to flow in the second tangential direction promote turbulence inside the housing, and wherein the turbulence promotes reduction in size of bubbles in the fluid.

A fifty-third embodiment can include the method of the fifty-second embodiment, further comprising inducing the fluid to flow in the first tangential direction at a third location inside the housing, wherein the third location is spaced axially apart from the second location, and wherein the second location is disposed between the first location and the third location.

A fifty-fourth embodiment can include the method of the fifty-second or fifty-third embodiments, further comprising inducing the fluid to flow in the second tangential direction at a fourth location inside the housing, wherein the fourth location is axially spaced apart from the third location, and wherein the second location and the third location are disposed between the first location and the fourth location.

A fifty-fifth embodiment can include the method of any of the fifty-second through fifty-fourth embodiments, further comprising inducing the fluid to flow in the first tangential direction at a fifth location inside the housing, wherein the fifth location is axially spaced apart from the fourth location, and wherein the second location, the third location, and the fourth location are disposed between the first location and the fifth location.

A fifty-sixth embodiment can include the method of any of the fifty-second through fifty-fifth embodiments, wherein the fluid is produced from a well.

A fifty-seventh embodiment can include the method of any of the fifty-second through fifty-sixth embodiments, wherein the housing is a housing of a gas separator.

A fifty-eighth embodiment can include the method of any of the fifty-second through fifty-seventh embodiments, wherein the flowing of the fluid from the annulus to inside the housing comprises flowing the fluid through inlet ports of a base.

A fifty-ninth embodiment can include the method of any of the fifty-second through fifty-eighth embodiments, wherein the first tangential direction is clockwise as viewed from uphole, and wherein the second tangential direction is counterclockwise as viewed from uphole.

A sixtieth embodiment can include the method of any of the fifty-second through fifty-eighth embodiments, wherein the first tangential direction is counterclockwise as viewed from uphole, and wherein the second tangential direction is clockwise as viewed from uphole.

A sixty-first embodiment can include the method of any of the fifty-second through sixtieth embodiments, wherein the inducing of the fluid to flow in the first tangential direction comprises inducing the fluid to flow in the first tangential direction by a first spider bearing at the first location.

A sixty-second embodiment can include the method of any of the fifty-second through sixty-first embodiments, wherein the first spider bearing is affixed to the housing, and a shaft extends through a first bore in the first spider bearing.

A sixty-third embodiment can include the method of any of the fifty-second through sixty-second embodiments, wherein the inducing of the fluid to flow in the second tangential direction comprises inducing the fluid to flow in the second tangential direction by a second spider bearing at the second location.

A sixty-fourth embodiment can include the method of any of the fifty-second through sixty-third embodiments, wherein the second spider bearing is affixed to the housing, and the shaft extends through a second bore in the second spider bearing.

A sixty-fifth embodiment can include the method of any of the fifty-second through sixty-fourth embodiments, wherein the first spider bearing comprising first vanes, a sign of a first pitch angle of the first vanes is opposite to a sign of a second pitch angle of the second vanes, and the first pitch angle and the second pitch angle are with respect to an uphole direction parallel to a longitudinal axis of the shaft.

A sixty-sixth embodiment can include the method of any of the fifty-second through sixty-fifth embodiments, wherein the flowing of the fluid from inside the housing to the annulus comprises flowing the fluid through a gas phase discharge in the housing.

A sixty-seventh embodiment can include the method of any of the fifty-second through sixty-sixth embodiments, wherein fluid flows axially from the first location to the second location.

In a sixty-eighth embodiment, a gas separator for an electric submersible pump comprises a first portion comprising a first inner circumferential surface and a first outer circumferential surface having a first diameter, wherein the first portion is disposed between an inlet and an outlet; and a second portion comprising a second inner circumferential surface and a second outer circumferential surface having a second diameter, wherein the second portion is disposed between the first portion and the outlet, wherein the first diameter is less than the second diameter.

A sixty-ninth embodiment can include the gas separator of the sixty-eighth embodiment, further comprising a base and a shaft, wherein the inlet is formed in the base, wherein the base has a third diameter that is greater than the first diameter, and wherein the shaft extends axially through the first portion and the second portion.

A seventieth embodiment can include the gas separator of the sixty-eighth or sixty-ninth embodiment, wherein the first portion is a first portion of a tubular structure and the second portion is a second portion of the tubular structure.

A seventy-first embodiment can include the gas separator of any of the sixty-eight through seventieth embodiments, further comprising a coupling disposed between the first portion and the second portion, wherein the coupling couples the first portion and the second portion, wherein the first portion is part of or an entirety of a first tubular, and wherein the second portion is part of or an entirety of a second tubular.

A seventy-second embodiment can include the gas separator of any of the sixty-ninth through seventy-first embodiments, comprising spider bearings affixed to the first inner circumferential surface, wherein each of the spider bearings comprises a bore, wherein a shaft extends through the bore of each of the spider bearings, wherein each of the spider bearings comprises vanes, and wherein the spider bearings are arranged in a pattern of alternating angular direction of the vanes.

A seventy-third embodiment can include the gas separator of any of the sixty-ninth through seventy-second embodiments, wherein the first portion and the second portion are configured to be disposed inside a casing comprising a third inner circumferential surface having a third diameter, and a difference between the third diameter and the first diameter is greater than a difference between the third diameter and the second diameter.

A seventy-fourth embodiment can include the gas separator of any of the sixty-ninth through seventy-third embodiments, wherein the first portion and the second portion are configured to be disposed inside a casing comprising a third inner circumferential surface, a first cross-sectional area between the first outer circumferential surface and the third inner circumferential surface is greater than a second cross-sectional area between the second outer circumferential surface and the third inner circumferential surface, the first cross-sectional area is uniform along an entire length of the first portion, and the second cross-sectional area is uniform along an entire length of the second portion.

A seventy-fifth embodiment can include the gas separator of any of the sixty-ninth through seventy-fourth embodiments, wherein the gas separator is configured such that a flow velocity along the first portion in an annulus between the gas separator and a casing is less than a flow velocity along the second portion in the annulus.

In a seventy-sixth embodiment, a method of assembling an electric submersible pump, comprises coupling the gas separator of any of the sixty-ninth through seventy-fifth embodiments, to a centrifugal pump assembly and a seal unit; and coupling the seal unit to an electric motor.

In a seventy-seventh embodiment, a method of lifting fluid in a wellbore comprises running the electric submersible pump of the seventy-sixth embodiment into a wellbore; and providing electric power to the electric motor.

In a seventy-eighth embodiment, a method of separating a gas phase from a liquid phase in fluid for pumping by an electric submersible pump comprises flowing fluid in a first axial direction through an interior of a first portion of a gas separator; flowing the fluid in the first axial direction through an interior of a second portion of the gas separator; flowing the fluid from the interior of the second portion into an annulus between the gas separator and a casing; flowing the fluid in a second axial direction through the annulus along the second portion, wherein the second axial direction is opposite to the first axial direction; flowing the fluid in the second axial direction through the annulus along the first portion; and flowing the fluid from the annulus into the interior of the first portion, wherein a velocity of the fluid (e.g., in the second axial direction) in the annulus along the second portion is greater than a velocity of the fluid (e.g., in the second axial direction) in the annulus along the first portion.

A seventy-ninth embodiment can include the method of the seventy-eighth embodiment, wherein the velocity of the fluid in the second axial direction in the annulus along the first portion is sufficiently low such that buoyancy force on bubbles entrained in the fluid in the annulus along the first portion overcomes drag force on the bubbles.

An eightieth embodiment can include the method of the seventy-seventh or seventy-eighth embodiments, wherein the flowing of the fluid from the interior of the second portion into the annulus comprises flowing the fluid through an outlet.

An eighty-first embodiment can include the method of any of the seventy-seventh through eightieth embodiments, wherein the outlet comprises a gas phase discharge.

An eighty-second embodiment can include the method of any of the seventy-seventh through eighty-first embodiments, wherein the flowing of the fluid from the annulus to the interior of the first portion comprises flowing the fluid through an inlet.

An eighty-third embodiment can include the method of any of the seventy-seventh through eighty-second embodiments, wherein the inlet comprises inlet ports.

An eighty-fourth embodiment can include the method of any of the seventy-seventh through eighty-third embodiments, wherein the inlet ports are formed in a base affixed to the first portion.

An eighty-fifth embodiment can include the method of any of the seventy-seventh through eighty-fourth embodiments, wherein the fluid comprises bubbles, and the gas separator is configured such that at least some of the bubbles travel in the first direction in the annulus to surface.

An eighty-sixth embodiment can include the method of any of the seventy-seventh through eighty-fifth embodiments, wherein the fluid comprises liquid, and the liquid flows in the second direction in the annulus and through an inlet.

An eighty-seventh embodiment can include the method of any of the seventy-seventh through eighty-sixth embodiments, wherein the first portion comprises a first outer circumferential surface having a first diameter, the second portion comprises a second outer circumferential surface having a second diameter, and the first diameter is less than the second diameter.

In an eight-eighth embodiment, a gas separator for an electric submersible pump, comprises a housing; a shaft extending through the housing, wherein the shaft is concentrically disposed with respect to the housing; a first spider bearing affixed to the housing and comprising first vanes, wherein the shaft extends through a first bore in the first spider bearing; and a second spider bearing affixed to the housing and comprising second vanes, wherein the shaft extends through a second bore in the second spider bearing, wherein a sign of a first pitch angle of the first vanes is opposite to a sign of a second pitch angle of the second vanes, and wherein the first pitch angle and the second pitch angle are with respect to an uphole direction parallel to a longitudinal axis of the shaft.

An eighty-ninth embodiment can include the gas separator of the eighty-eighth embodiment, wherein the sign of the first pitch angle is positive according to a right-handed convention, and the sign of the second pitch angle is negative according to the right-handed convention.

A ninetieth embodiment can include the gas separator of the eighty-eighth or eighty-ninth embodiments, wherein the first pitch angle is 30 to 60 degrees according to the right-handed convention, and the second pitch angle is −60 to −30 degrees according to the right-hand convention.

A ninety-first embodiment can include the gas separator of any of the eighty-eighth through ninetieth embodiments, wherein the sign of the first pitch angle is negative according to a right-handed convention, and the sign of the second pitch angle is positive according to the right handed-convention.

A ninety-second embodiment can include the gas separator of any of the eighty-eighth through ninety-first embodiments, wherein the first pitch angle is −60 to −30 degrees according to the right-handed convention, and wherein the second pitch angle is 30 to 60 degrees according to the right-handed convention.

A ninety-third embodiment can include the gas separator of any of the eighty-eighth through ninety-second embodiments, further comprising a third spider bearing affixed to the housing and comprising third vanes, wherein the shaft extends through a third bore in the third spider bearing, and wherein a sign of a third pitch angle of the third vanes is opposite to a sign of the second pitch angle; a fourth spider bearing affixed to the housing and comprising fourth vanes, wherein the shaft extends through a fourth bore in the fourth spider bearing, and wherein a sign of a fourth pitch angle of the fourth vanes is opposite to a sign of the third pitch angle; and a fifth spider bearing affixed to the housing and comprising fifth vanes, wherein the shaft extends through a fifth bore in the fifth spider bearing, and wherein a sign of a fifth pitch angle of the fifth vanes is opposite to a sign of the fourth pitch angle.

A ninety-fourth embodiment can include the gas separator of any of the eighty-eighth through ninety-third embodiments, wherein the housing comprises a first portion and a second portion, the first spider bearing and the second spider bearing are disposed in the first portion, a fluid mover is disposed in the second portion, and an outer diameter of the first portion is less than an outer diameter of the second portion.

A ninety-fifth embodiment can include the gas separator of any of the eighty-eighth through ninety-fourth embodiments, wherein the first portion is a first portion of a tubular and the second portion is a second portion of the tubular, or a coupling couples the first portion and the second portion.

In a ninety-sixth embodiment, method of assembling an electric submersible pump, comprises coupling the gas separator of any of the eighty-eighth through ninety-fifth embodiments to a centrifugal pump assembly and a seal unit; and coupling the seal unit to an electric motor.

In a ninety-seventh embodiment, a method of lifting fluid in a wellbore comprises running the electric submersible pump of the ninety-sixth embodiment into a wellbore; and providing electric power to the electric motor.

In a ninety-eighth embodiment, a method of reducing bubble size in fluid for pumping by an electric submersible pump, comprising: flowing fluid from an annulus into an interior of a housing through an intake hole; inducing the fluid to flow in a first tangential direction at a first location in the interior of the housing; inducing the fluid to flow in a second tangential direction at a second location in the interior of the housing, wherein the first tangential direction is opposite to the second tangential direction, and wherein the first location and the second location are axially spaced apart; flowing the fluid from the interior of the housing into the annulus; and flowing the fluid in a downhole direction through the annulus, wherein the inducing of the fluid to flow in the first tangential direction and the inducing of the fluid to flow in the second tangential direction promotes turbulence in the interior of the housing, and wherein the turbulence promotes reduction in size of bubbles in the fluid.

A ninety-ninth embodiment can include the method of the ninety-eighth embodiment, further comprising: inducing the fluid to flow in the first tangential direction at a third location in the interior of the housing, wherein the third location is axially spaced apart from the second location, and wherein the second location is disposed between the first location and the third location; inducing the fluid to flow in the second tangential direction at a fourth location in the interior of the housing, wherein the fourth location is axially spaced apart from the third location, and wherein the second location and the third location are disposed between the first location and the fourth location; and inducing the fluid to flow in the first tangential direction at a fifth location in the interior of the housing, wherein the fifth location is axially spaced apart from the fourth location, and wherein the second location, the third location, and the fourth location are disposed between the first location and the fifth location.

A one-hundredth embodiment can include the method of the ninety-eighth or ninety-ninth embodiments, wherein the housing is a housing of a gas separator.

A one-hundred-first embodiment can include the method of any of the ninety-eighth through one-hundredth embodiments, wherein the flowing of the fluid from the annulus into the interior of the housing comprises flowing the fluid through inlet ports of a base, and wherein the flowing of the fluid from the interior of the housing to the annulus comprises flowing the fluid through a gas phase discharge in the housing.

A one-hundred-second embodiment can include the method of any of the ninety-eighth through one-hundred-first embodiments, wherein the first tangential direction is clockwise as viewed from uphole, and wherein the second tangential direction is counterclockwise as viewed from uphole.

A one-hundred-third embodiment can include the method of any of the ninety-eighth through one-hundred-second embodiments, wherein the first tangential direction is counterclockwise as viewed from uphole, and wherein the second tangential direction is clockwise as viewed from uphole.

A one-hundred-fourth embodiment can include the method of any of the ninety-eighth through one-hundred-second embodiments, wherein the inducing of the fluid to flow in the first tangential direction comprises inducing the fluid to flow in the first tangential direction by a first spider bearing at the first location, and the inducing of the fluid to flow in the second tangential direction comprises inducing the fluid to flow in the second tangential direction by a second spider bearing at the second location.

A one-hundred-fifth embodiment can include the method of any of the ninety-eighth through one-hundred-fourth embodiments, wherein the first spider bearing and the second spider bearing are affixed to the housing.

A one-hundred-sixth embodiment can include the method of any of the ninety-eighth through one-hundred-fifth embodiments, wherein a shaft extends through a first bore in the first spider bearing and a second bore in the second spider bearing.

A one-hundred-seventh embodiment can include the method of any of the ninety-eighth through one-hundred sixth embodiments, a sign of a first pitch angle of first vanes of the first spider bearing is opposite to a sign of a second pitch angle of second vanes of the second spider bearing, and the first pitch angle and the second pitch angle are with respect to an uphole direction parallel to a longitudinal axis of the shaft.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations. For example, whenever a numerical range with a lower limit, $R_l$, and an upper limit, Ru, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent . . . 50 percent, 51 percent, 52 percent . . . 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. The use of terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. Any discussion of a reference herein is not an admission that it is prior art. Any disclosures of all patents, patent applications, and/or publications cited herein are hereby incorporated by reference, to the extent that they provide exemplary, procedural, or other details supplementary to those set forth herein.

As used herein, the term "or" does not require selection of only one element. Thus, the phrase "A or B" is satisfied by either one or both elements from the set {A, B}. A clause that recites "A or B" can be infringed with only one of the listed items, both of the listed items, multiples of the listed items, and one or both of the listed items and another item not listed. The phrase "A, B, or C" is satisfied by any one or any combination of any two or more from the set {A, B, C}. A clause that recites "A, B, or C" can be infringed with only one of the listed items, multiples of the listed items, and one or more of the items from the list and another item not listed.

As used herein, the article "a" means "one or more." As used herein, the article "an" means "one or more." As used herein, the article "the" when referring to a singular noun means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A gas separator for an electric submersible pump, comprising:

a first portion comprising a first inner circumferential surface and a first outer circumferential surface having a first diameter, wherein the first portion is disposed between an inlet and an outlet; and a second portion comprising a second inner circumferential surface and a second outer circumferential surface having a second diameter, wherein the second portion is disposed between the first portion and the outlet, wherein the first diameter is less than the second diameter, and wherein the first diameter is uniform along an entire length of the first portion.

2. The gas separator of claim 1, further comprising a base and a shaft, wherein the inlet is formed in the base, wherein the base has a third diameter that is greater than the first diameter, and wherein the shaft extends axially through the first portion and the second portion.

3. The gas separator of claim 1, wherein the first portion is a first portion of a tubular structure and the second portion is a second portion of the tubular structure.

4. The gas separator of claim 1, further comprising a coupling disposed between the first portion and the second portion, wherein the coupling couples the first portion and the second portion, wherein the first portion is part of or an entirety of a first tubular, and wherein the second portion is part of or an entirety of a second tubular.

5. The gas separator of claim 1, further comprising spider bearings affixed to the first inner circumferential surface, wherein each of the spider bearings comprises a bore, wherein a shaft extends through the bore of each of the spider bearings, wherein each of the spider bearings comprises vanes, and wherein the spider bearings are arranged in a pattern of alternating angular direction of the vanes.

6. The gas separator of claim 1, wherein the first portion and the second portion are configured to be disposed inside a casing comprising a third inner circumferential surface having a third diameter, and a difference between the third diameter and the first diameter is greater than a difference between the third diameter and the second diameter.

7. The gas separator of claim 1, wherein the first portion and the second portion are configured to be disposed inside a casing comprising a third inner circumferential surface, a first cross-sectional area between the first outer circumferential surface and the third inner circumferential surface is greater than a second cross-sectional area between the second outer circumferential surface and the third inner circumferential surface, the first cross-sectional area is uniform along an entire length of the first portion, and the second cross-sectional area is uniform along an entire length of the second portion.

8. The gas separator of claim 1, wherein the gas separator is configured such that a flow velocity along the first portion in an annulus between the gas separator and a casing is less than a flow velocity along the second portion in the annulus.

9. A method of assembling an electric submersible pump, comprising:

coupling the gas separator of claim 1 to a centrifugal pump assembly and a seal unit; and coupling the seal unit to an electric motor.

10. A method of lifting fluid in a wellbore, comprising:

running the electric submersible pump of claim 9 into a wellbore; and providing electric power to the electric motor.

11. A method of separating a gas phase from a liquid phase in fluid for pumping by an electric submersible pump, comprising:

flowing fluid in a first axial direction through an interior of a first portion of a gas separator;

flowing the fluid in the first axial direction through an interior of a second portion of the gas separator;

flowing the fluid from the interior of the second portion into an annulus between the gas separator and a casing;

flowing the fluid in a second axial direction through the annulus along the second portion, wherein the second axial direction is opposite to the first axial direction;

flowing the fluid in the second axial direction through the annulus along the first portion; and flowing the fluid from the annulus into the interior of the first portion, wherein a velocity of the fluid in the annulus along the second portion is greater than a velocity of the fluid in the annulus along the first portion, wherein a first diameter of a first outer circumferential surface of the first portion is less than a second diameter of a second outer circumferential surface of the second portion, and wherein the first diameter is uniform along an entire length of the first portion.

12. The method of claim 11, wherein the velocity of the fluid in the second axial direction in the annulus along the first portion is sufficiently low such that buoyancy force on bubbles entrained in the fluid in the annulus along the first portion overcomes drag force on the bubbles.

13. The method of claim 11, wherein the flowing of the fluid from the interior of the second portion into the annulus comprises flowing the fluid through an outlet.

14. The method of claim 13, wherein the outlet comprises a gas phase discharge.

15. The method of claim 11, wherein the flowing of the fluid from the annulus to the interior of the first portion comprises flowing the fluid through an inlet.

16. The method of claim 15, wherein the inlet comprises inlet ports.

17. The method of claim 16, wherein the inlet ports are formed in a base affixed to the first portion.

18. The method of claim 11, wherein the fluid comprises bubbles, and the gas separator is configured such that at least some of the bubbles travel in the first direction in the annulus to surface.

19. The method of claim 11, wherein the fluid comprises liquid, and the liquid flows in the second direction in the annulus and through an inlet.

20. A gas separator for an electric submersible pump, comprising:

a first portion comprising a first inner circumferential surface and a first outer circumferential surface having a first diameter, wherein the first portion is disposed between an inlet and an outlet;

a second portion comprising a second inner circumferential surface and a second outer circumferential surface having a second diameter, wherein the second portion is disposed between the first portion and the outlet, and wherein the first diameter is less than the second diameter; and spider bearings affixed to the first inner circumferential surface, wherein each of the spider bearings comprises a bore, wherein a shaft extends through the bore of each of the spider bearings, wherein each of the spider bearings comprises vanes, and wherein the spider bearings are arranged in a pattern of alternating angular direction of the vanes.

* * * * *